US011174537B2

(12) United States Patent
Kuniyoshi

(10) Patent No.: US 11,174,537 B2
(45) **Date of Patent: *Nov. 16, 2021**

(54) R-T-B SINTERED MAGNET

(71) Applicant: HITACHI METALS, LTD., Tokyo (JP)

(72) Inventor: Futoshi Kuniyoshi, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 331 days.

This patent is subject to a terminal disclaimer.

(21) Appl. No.: 16/324,584

(22) PCT Filed: Aug. 14, 2017

(86) PCT No.: PCT/JP2017/029270

§ 371 (c)(1),
(2) Date: Feb. 11, 2019

(87) PCT Pub. No.: WO2018/034264

PCT Pub. Date: Feb. 22, 2018

(65) Prior Publication Data

US 2019/0185971 A1 Jun. 20, 2019

(30) Foreign Application Priority Data

Aug. 17, 2016 (JP) ..... JP2016-159913
Jan. 31, 2017 (JP) ..... JP2017-015396

(51) Int. Cl.
*C22C 28/00* (2006.01)
*H01F 1/057* (2006.01)
(Continued)

(52) U.S. Cl.
CPC ..... *C22C 28/00* (2013.01); *B22F 3/16* (2013.01); *C22C 1/04* (2013.01); *C22C 38/00* (2013.01);
(Continued)

(58) Field of Classification Search
CPC ..... B22F 2301/45; B22F 3/00; C22C 1/04; C22C 2202/02; H01F 1/057; H01F 1/0577; H01F 41/02; H01F 41/0293
(Continued)

(56) References Cited

U.S. PATENT DOCUMENTS 10,388,441 B2 * 8/2019 Kanada ..... C22C 38/002
2011/0205006 A1 8/2011 Odaka et al.
(Continued)

FOREIGN PATENT DOCUMENTS

GN 107077965 A 8/2017
JP 2014-130888 A 7/2014
(Continued)

OTHER PUBLICATIONS

NPL: on-line English translation of JP 2014130888 A, Jul. 2014 (Year: 2014).*
(Continued)

*Primary Examiner* — Jie Yang
(74) *Attorney, Agent, or Firm* — Keating & Bennett, LLP

(57) ABSTRACT

A sintered R-T-B based magnet includes a main phase crystal grain and a grain boundary phase, in which R: not less than 27.5 mass % and not more than 35.0 mass % (R always includes at least Nd and Pr); B: not less than 0.80 mass % and not more than 1.05 mass %; Ga: not less than 0.05 mass % and not more than 1.0 mass %; M: not more than 2 mass % (where M is at least one of Cu, Al, Nb, and Zr); and a balance T (where T is Fe, or Fe and Co) and impurities. At 300-μm depth from the magnet surface, a Pr/Nd ratio in a central portion of a main phase crystal grain is lower than 1, and a Pr/Nd ratio in an intergranular grain
(Continued)

boundary is higher than 1. The Ga concentration gradually decreases in a portion of the magnet from the surface toward the interior.

7 Claims, 1 Drawing Sheet

(51) Int. Cl.

| | |
|---|---|
| ***C22C 38/00*** | (2006.01) |
| ***H01F 41/02*** | (2006.01) |
| ***B22F 3/16*** | (2006.01) |
| ***C22C 1/04*** | (2006.01) |
| *B22F 3/02* | (2006.01) |
| *B22F 3/00* | (2021.01) |
| *B22F 3/24* | (2006.01) |

(52) U.S. Cl.
CPC ..... *H01F 1/057* (2013.01); *H01F 1/0577* (2013.01); *H01F 41/02* (2013.01); *B22F 3/00* (2013.01); *B22F 3/02* (2013.01); *B22F 3/24* (2013.01); *B22F 2301/45* (2013.01); *C22C 2202/02* (2013.01); *H01F 41/0266* (2013.01)

(58) Field of Classification Search
USPC ..... 148/302
See application file for complete search history.

(56) References Cited

U.S. PATENT DOCUMENTS

| | | | | |
|---|---|---|---|---|
| 2013/0078369 | A1 | 3/2013 | Shoji et al. | |
| 2014/0132377 | A1 | 5/2014 | Nakajima et al. | |
| 2017/0256344 | A1 | 9/2017 | Satoh et al. | |
| 2018/0240590 | A1* | 8/2018 | Kuniyoshi | C22C 38/14 |
| 2019/0211419 | A1* | 7/2019 | Conway | C22B 15/0006 |

FOREIGN PATENT DOCUMENTS

| | | | | |
|---|---|---|---|---|
| WO | 2009/031292 | A1 | 3/2009 | |
| WO | 2012/036294 | A1 | 3/2012 | |
| WO | 2013/008756 | A1 | 1/2013 | |
| WO | WO-2015020182 | A1 * | 2/2015 | C22C 38/02 |
| WO | 2016/043039 | A1 | 3/2016 | |

OTHER PUBLICATIONS

Official Communication issued in Chinese Patent Application No. 201780045364.3, dated Nov. 15, 2019.
Official Communication issued in International Patent Application No. PCT/JP2017/029270, dated Nov. 14, 2017.

* cited by examiner

R-T-B SINTERED MAGNET

TECHNICAL FIELD

The present invention relates to a sintered R-T-B based magnet.

BACKGROUND ART

Sintered R-T-B based magnets (where R is at least one rare-earth element which always includes Nd; T is Fe, or Fe and Co; and B is boron) are known as permanent magnets with the highest performance, and are used in voice coil motors (VCM) of hard disk drives, various types of motors such as motors for electric vehicles (EV, HV, PHV, etc.) and motors for industrial equipment, home appliance products, and the like.

A sintered R-T-B based magnet is composed of a main phase which mainly consists of an $R_2T_{14}B$ compound and a grain boundary phase that is at the grain boundaries of the main phase. The main phase, i.e., an $R_2T_{14}B$ compound, has a high saturation magnetization and anisotropy field, and provides a basis for the properties of a sintered R-T-B based magnet. Coercivity $H_{cJ}$ (which hereinafter may be simply referred to as "$H_{cJ}$") of sintered R-T-B based magnets decreases at high temperatures, thus causing an irreversible thermal demagnetization. For this reason, sintered R-T-B based magnets for use in motors for electric vehicles, in particular, are required to have high $H_{cJ}$.

It is known that $H_{cJ}$ is improved if a light rare-earth element RL (e.g., Nd or Pr) contained in the R of the $R_2T_{14}B$ compound of a sintered R-T-B based magnet is partially replaced with a heavy rare-earth element RH (which is at least one of Dy and Tb). $H_{cJ}$ is more improved as the amount of substituted RH increases.

However, replacing the RL in the $R_2T_{14}B$ compound with an RH may improve the $H_{cJ}$ of the sintered R-T-B based magnet, but decrease its remanence $B_r$ (which hereinafter may be simply referred to as "$B_r$"). Moreover, RHs, in particular Dy and the like, are a scarce resource, and they yield only in limited regions. For this and other reasons, they have problems of instable supply, significantly fluctuating prices, and so on. Therefore, in the recent years, it has been desired to improve $H_{cJ}$ while using as little RH as possible.

Patent Document 1 discloses an R-T-B based rare-earth sintered magnet which attains high coercivity while keeping the Dy content low. The composition of this sintered magnet is limited to a specific range where the B amount is comparatively smaller than in an R-T-B based alloy (which has been the conventional choice), and contains one or more metallic elements M selected from the group consisting of Al, Ga and Cu. As a result, an $R_2T_{17}$ phase occurs near the grain boundaries, and the volume ratio of a transition metal-rich phase ($R_6T_{13}M$) that is created near the grain boundaries from this $R_2T_{17}$ phase increases, whereby $H_{cJ}$ is improved.

CITATION LIST

Patent Literature

[Patent Document 1] International Publication No. 2013/008756

SUMMARY OF INVENTION

Technical Problem

The R-T-B based rare-earth sintered magnet disclosed in Patent Document 1 has a problem in that, while high $H_{cJ}$ is obtained with a reduced Dy content, $B_r$ is greatly lowered. Moreover, in recent years, sintered R-T-B based magnets with even higher $H_{cJ}$ have been desired in applications such as motors for electric vehicles.

Various embodiments of the present invention provide methods for producing a sintered R-T-B based magnet which attains high $B_r$ and high $H_{cJ}$ while reducing the RH content.

Solution to Problem

A sintered R-T-B based magnet according to the present disclosure is a sintered R-T-B based magnet comprising a main phase crystal grain and a grain boundary phase, the sintered R-T-B based magnet containing: R: not less than 27.5 mass % and not more than 35.0 mass % (R is at least one rare-earth element which always includes Nd and Pr); B: not less than 0.80 mass % and not more than 1.05 mass %; Ga: not less than 0.05 mass % and not more than 1.0 mass %; M: not less than 0 mass % and not more than 2 mass % (where M is at least one of Cu, Al, Nb and Zr); and a balance T (where T is Fe, or Fe and Co) and impurities, wherein, a Pr/Nd which is a ratio of a concentration of Pr to a concentration of Nd in a central portion of a main phase crystal grain that is located at a depth of 300 μm from a magnet surface is lower than 1; and a Pr/Nd which is a ratio of a concentration of Pr to a concentration of Nd in an intergranular grain boundary that is located at a depth of 300 μm from the magnet surface is higher than 1; and a portion in which the Ga concentration gradually decreases from the magnet surface toward a magnet interior (i.e., in the depth direction) exists.

In one embodiment, $[T]/55.85>14[B]/10.8$ is satisfied, where [T] is the T content in mass % and [B] is the B content in mass %.

In one embodiment, the heavy rare-earth element (where the heavy rare-earth element is at least one of Dy and Tb) accounts for 1 mass % or less.

In one embodiment, the heavy rare-earth element (where the heavy rare-earth element is at least one of Dy and Tb) accounts for not less than 0.05 mass % and not more than 0.30 mass %.

In one embodiment, the RH concentration in an outer crust of the main phase crystal grain that is located at a depth of 300 μm from the magnet surface is higher than the RH concentration in the central portion of the main phase crystal grain.

In one embodiment, the Pr/Nd in the intergranular grain boundary that is located at a depth of 300 μm from the magnet surface is higher than 1.1.

In one embodiment, the B concentration is in a range of not less than 0.80 mass % and not more than 0.95 mass %.

In one embodiment, a C concentration in an intergranular grain boundary that is located at a depth of 300 μm from the magnet surface is 2 mass % or less.

Advantageous Effects of Invention

According to an embodiment of the present disclosure, since Pr and Ga are diffused deep into the magnet interior, it is possible to obtain high $B_r$ and high $H_{cJ}$ while reducing the RH content.

DESCRIPTION OF EMBODIMENTS

Figure 1A:
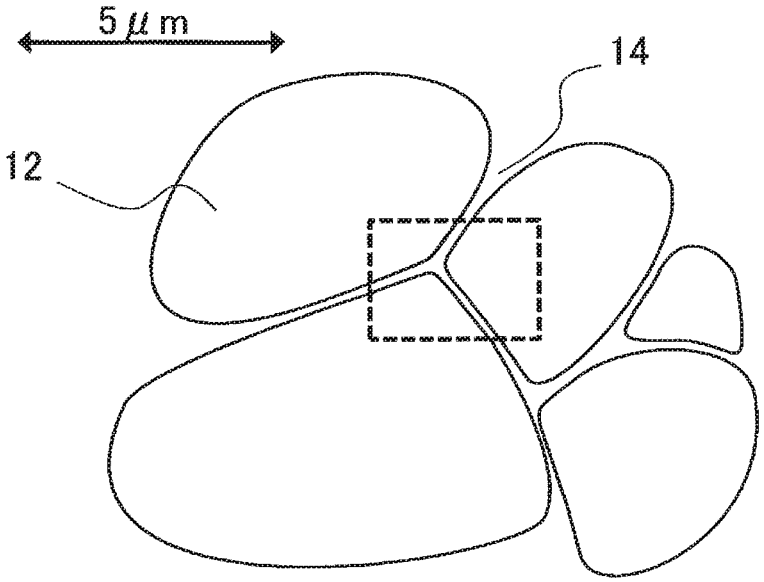
FIG. 1A A schematic diagram showing a main phase and a grain boundary phase of a sintered R-T-B based magnet.

A sintered R-T-B based magnet according to the present disclosure contains a main phase crystal grain and a grain boundary phase, and in an embodiment, contains:

R: not less than 27.5 mass % and not more than 35.0 mass % (R is at least one rare-earth element which always includes Nd and Pr);

B: not less than 0.80 mass % and not more than 1.05 mass %;

Ga: not less than 0.05 mass % and not more than 1.0 mass %;

M: not less than 0 mass % and not more than 2 mass % (where M is at least one of Cu, Al, Nb and Zr); and a balance T (where T is Fe, or Fe and Co) and impurities.

In a sintered R-T-B based magnet according to the present disclosure, a Pr/Nd which is a ratio of a concentration of Pr to a concentration of Nd in a central portion of a main phase crystal grain that is located at a depth of 300 μm from the magnet surface is lower than 1; and a Pr/Nd which is a ratio of a concentration of Pr to a concentration of Nd in an intergranular grain boundary that is located at a depth of 300 μm from the magnet surface is higher than 1. Moreover, a portion in which the Ga concentration gradually decreases from the magnet surface toward the magnet interior exists.

Note that the conditions that "a Pr/Nd which is a ratio of a concentration of Pr to a concentration of Nd in a central portion of a main phase crystal grain that is located at a depth of 300 μm from the magnet surface is lower than 1; and a Pr/Nd which is a ratio of a concentration of Pr to a concentration of Nd in an intergranular grain boundary that is located at a depth of 300 μm from the magnet surface is higher than 1" do not need to be satisfied for every main phase crystal grain and every intergranular grain boundary at a depth of 300 μm from the magnet surface of the entire magnet; rather, it is sufficient if a portion of the magnet satisfies the aforementioned conditions. This is because high $B_r$ and high $H_{cJ}$ may not necessarily be needed across the entire magnet, but may well be achieved in only a part of the magnet in certain cases (e.g., when the magnet is used in a motor, high $B_r$ and high $H_{cJ}$ may be required at magnet ends).

From the standpoint of achieving a high coercivity with greater certainty, a Pr/Nd in an intergranular grain boundary that is located at a depth of 300 μm from the magnet surface is preferably higher than 1.1. From a similar standpoint, the B concentration is in a range of not less than 0.80 mass % and not more than 0.95 mass %.

A sintered R-T-B based magnet according to the present disclosure contains Pr and Ga which have been introduced from the surface via diffusion through the grain boundaries. In a preferable embodiment, Nd accounts for 50 mol % or more (and preferably, 70% mol or more) of the rare-earth element R, and Pr accounts for not less than 0.5 mol % but less than 50 mol % of the rare-earth element R. Pr/Nd being higher than 1 in an intergranular grain boundary, despite the fact that Pr/Nd is lower than 1 in a central portion of a main phase crystal grain that is located at a depth of 300 μm from the magnet surface, means that Pr abounds in the grain boundary, rather than in the main phase. On the other hand, the Ga concentration gradually decreasing from the magnet surface toward the magnet interior means that Ga has been diffused from the magnet surface into the magnet interior (in the depth direction). Note that, in a sintered R-T-B based magnet according to the present disclosure, Pr is also diffused from the magnet surface into the magnet interior; therefore, as in the case of Ga, there exists a site in which the Pr concentration gradually decreases from the magnet surface toward the magnet interior. Existence of a site in which the Pr concentration gradually decreases can be confirmed by a method which is similar to that used in the case of gradually decreasing Ga concentration, as will be described below.

In a preferable embodiment, the portion in which the Ga concentration gradually decreases possesses at least a size of 200 μm from the magnet surface toward the magnet interior. Specifically, when an average value of Ga concentration is to be measured with respect to layer regions each having a thickness of 100 μm from the magnet surface, the average value of Ga concentration in the respective layer region decreases, relative to any layer region that is located closer to the magnet surface, in a layer region which adjoins that layer region but which is located closer to the magnet interior. For example, consider measuring an average Ga concentration (a first Ga concentration) in a region down to a position which is 100 μm deep from the magnet surface, an average Ga concentration (a second Ga concentration) in a region from the position which is 100 μm deep to a position which is 200 μm deep, and an average Ga concentration (a third Ga concentration) in a region from the position which is 200 μm deep to a position which is 300 μm deep. Then, if the second Ga concentration is lower than the first Ga concentration, it is decided that the portion in which the Ga concentration gradually decreases possesses at least a size of 200 μm from the magnet surface toward the magnet interior. Moreover, if the second Ga concentration is lower than the first Ga concentration and yet the third Ga concentration is lower than the second Ga concentration, it is then decided that a portion in which the Ga concentration gradually decreases possesses a size of 300 μm (at least 200 μm) from the magnet surface toward the magnet interior.

In a preferable embodiment, this sintered R-T-B based magnet satisfies the following inequality (1), where [T] is a T content (mass %) and [B] is a B content (mass %).

$$[T]/55.85>14[B]/10.8 \quad (1)$$

This inequality being satisfied means that the B content is smaller than what is defined by the stoichiometric ratio of the $R_2T_{14}B$ compound, i.e., that the B amount is relatively small with respect to the T amount consumed in composing the main phase (i.e., $R_2T_{14}B$ compound).

In the meaning of the present disclosure, "a Pr/Nd which is a ratio of a concentration of Pr to a concentration of Nd in a central portion of a main phase crystal grain that is located at a depth of 300 μm from the magnet surface" is what is obtained by dividing a Pr concentration (mass %), by an Nd concentration (mass %), in a central portion of a main phase crystal grain that is located at 300 μm (in the depth direction) from the magnet surface. A "Pr/Nd which is a ratio of a concentration of Pr to a concentration of Nd in an intergranular grain boundary that is located at a depth of 300 μm from the magnet surface" is what is obtained by dividing a Pr concentration (mass %), by an Nd concentration (mass %), in an intergranular grain boundary at which two main phase crystal grains that are located at 300 μm (in the depth direction) from the magnet surface adjoin each other.

Pr and Nd concentrations may be determined as follows, for example.

First, in a magnet cross section of the sintered R-T-B based magnet, a crystal grain (a main phase crystal grain)

and an intergranular grain boundary are observed by using a transmission electron microscope (TEM). The place at which to observe a main phase crystal grain and an intergranular grain boundary is always a magnet cross section at 300 μm from the surface of the sintered R-T-B based magnet.

Next, by using energy dispersive X-ray spectroscopy (EDX), a composition analysis is conducted for a Pr concentration (mass %) and an Nd concentration (mass %) as contained in the central portion of the main phase crystal grain and the intergranular grain boundary (which may be anywhere in the intergranular grain boundary). As a result, Pr and Nd concentrations can be determined.

In the present disclosure, regarding whether "there exists a portion in which the Ga concentration from the magnet surface toward the magnet interior gradually decreases", the Ga concentration in a main phase crystal grain and a grain boundary is continuously measured, to a depth of at least 200 μm into the magnet interior from the magnet surface, in order to confirm whether the Ga concentration gradually decreases or not. Depending on whether the measurement site is in a main phase crystal grain or at a grain boundary, or on the kind and presence/absence of Ga compound within a starting material (i.e., in the sintered R-T-B based magnet work) or Ga compound occurring at the time of diffusion, the Ga concentration may locally decrease or increase. However, the overall Ga concentration will gradually decrease toward the magnet interior. Therefore, regardless of some local decreases and increases in the Ga concentration, so long as the Ga amount as a whole gradually decreases toward a depth of at least 200 μm into the magnet interior from the magnet surface, it is said in the present disclosure that "there exists a portion in which the Ga concentration from the magnet surface toward the magnet interior gradually decreases". As the method of measurement, for example, in an arbitrary cross section of the sintered R-T-B based magnet, an extent from the magnet surface to near the magnet center may be subjected to a line analysis by the aforementioned EDX for the confirmation.

A sintered R-T-B based magnet according to the present disclosure may be suitably produced e.g. by a production method which includes, as will be described in detail later: a step of allowing at least a portion of a Pr—Ga alloy to be in contact with at least a portion of the surface of a sintered R-T-B based magnet work, and performing a first heat treatment at a temperature which is above 600° C. but not higher than 950° C. in a vacuum or an inert gas ambient; and a step of subjecting the sintered R-T-B based magnet work having undergone the first heat treatment to a second heat treatment at a temperature which is lower than the temperature used in the step of performing the first heat treatment and which is not lower than 450° C. and not higher than 750° C., in a vacuum or an inert gas ambient. The step of performing the first heat treatment is performed before the step of performing the second heat treatment. Between the step of performing a first heat treatment and the step of performing a second heat treatment, other steps, e.g., a cooling step, a step of retrieving the sintered R-T-B based magnet work out of a mixture of the Pr—Ga alloy and the sintered R-T-B based magnet work, and the like may be performed.

Herein, the sintered R-T-B based magnet work contains:

R: not less than 27.5 mass % and not more than 35.0 mass % (R is at least one rare-earth element which always includes Nd), B: not less than 0.80 mass % and not more than 1.05 mass %, Ga: not less than 0 mass % and not more than 0.7 mass %; and M: not less than 0 mass % and not more than 2 mass % (where M is at least one of Cu, Al, Nb and Zr), and includes a balance T (where T is Fe, or Fe and Co) and impurities.

The B amount in the sintered R-T-B based magnet work is preferably in a range of not less than 0.80 mass % and not more than 0.99 mass %, and more preferably in a range of not less than 0.80 mass % and not more than 0.95 mass %, as this can provide even higher $H_{cJ}$. Moreover, the Ga amount in the sintered R-T-B based magnet work is preferably 0.8 mass % or less. The Pr concentration and the Ga concentration in the sintered R-T-B based magnet work may each be 0 mass %.

Moreover, the Pr—Ga alloy is an alloy of not less than 65 mass % and not more than 97 mass % of Pr and not less than 3 mass % and not more than 35 mass % of Ga. However, 20 mass % or less of Pr may be replaced with Nd. Moreover, 30 mass % or less of Pr may be replaced with Dy and/or Tb. Furthermore, 50 mass % or less of Ga may be replaced with Cu. That "20 mass % or less of Pr in the present disclosure may be replaced with Nd" means that, by defining the Pr content (mass %) in the Pr—Ga alloy to be 100%, 20% or less thereof can be replaced with Nd. For example, if Pr accounts for 80 mass % in the Pr—Ga alloy, 16 mass % or less thereof may be replaced with Nd. The same is also true of Dy, Tb and Cu. The Pr—Ga alloy may contain 5 mass % or less of impurities.

1. Mechanism

The sintered R-T-B based magnet has a structure such that powder particles of a raw material alloy have bound together through sintering, and is composed of a main phase which mainly consists of an $R_2T_{14}B$ compound and a grain boundary phase which is at the grain boundaries of the main phase.

Figure 1B:
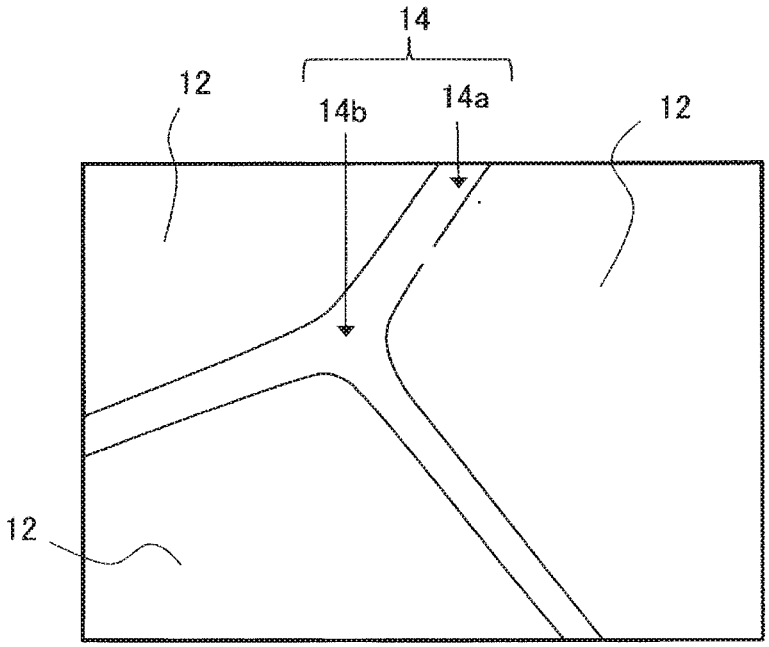
FIG. 1B A further enlarged cross-sectional view schematically showing the interior of a broken-lined rectangular region in FIG. 1A.

FIG. 1A is a schematic diagram showing a main phase and a grain boundary phase of a sintered R-T-B based magnet. FIG. 1B is a further enlarged cross-sectional view schematically showing the interior of a broken-lined rectangular region in FIG. 1A. In FIG. 1A, arrowheads indicating a length of 5 μm are shown as an example of reference length to represent size. As shown in FIG. 1A and FIG. 1B, the sintered R-T-B based magnet is composed of a main phase which mainly consists of an $R_2T_{14}B$ compound 12 and a grain boundary phase 14 which is at the grain boundaries of the main phase 12. Moreover, as shown in FIG. 1B, the grain boundary phase 14 includes an intergranular grain boundary phase 14*a* in which two $R_2T_{14}B$ compound grains adjoin each other, and grain boundary triple junctions 14*b* at which three (or, three or more in some cases) $R_2T_{14}B$ compound grains adjoin one another.

The main phase 12, i.e., the $R_2T_{14}B$ compound, is a ferromagnetic material having high saturation magnetization and an anisotropy field. Therefore, in a sintered R-T-B based magnet, it is possible to improve $B_r$ by increasing the abundance ratio of the $R_2T_{14}B$ compound which is the main phase 12. In order to increase the abundance ratio of the $R_2T_{14}B$ compound, the R amount, the T amount, and the B amount in the raw material alloy may be brought closer to the stoichiometric ratio of the $R_2T_{14}B$ compound (i.e., the R amount: the T amount: the B amount=2:14:1). If the B amount or the R amount for composing the $R_2T_{14}B$ compound is smaller than is defined by the stoichiometric ratio, a magnetic substance such as an Fe phase or an $R_2T_{17}$ phase may occur in the grain boundary phase 14, which will drastically lower $H_{cJ}$. It has however been believed that, even if the B amount is lower than is defined by the stoichiometric ratio, for example, an R-T-Ga phase will be generated in the grain boundary when Ga is contained in the magnet composition, instead of an Fe phase and an $R_2T_{17}$ phase, thereby suppressing the decrease in $H_{cJ}$.

However, it has been found through a study by the inventors that, when Ga is added to the raw material alloy, or added to a raw material alloy powder that is formed through pulverization of a raw material alloy, Ga will be contained not only in the grain boundary phase 14 but also partly in the main phase 12, thus lowering magnetization of the main phase 12, whereby $B_r$ may possibly lower. Therefore, in order to obtain high $B_r$, the added amount of Ga needs to be reduced. On the other hand, if the added amount of Ga is too small, the Fe phase and the $R_2T_{17}$ phase will remain in the grain boundary phase 14, thereby lowering $H_{cJ}$. In other words, it has been found difficult to achieve both high $B_r$ and high $H_{cJ}$ when Ga is added to a raw material alloy and/or a raw material alloy powder.

In order to solve the above problem, a further study was conducted, which revealed that Ga can be restrained from becoming partly contained in the main phase 12 if Ga is introduced into the sintered R-T-B based magnet work by performing specific heat treatments while at least a portion of a Pr—Ga alloy is kept in contact with at least a portion of the surface of the sintered R-T-B based magnet work of the aforementioned specific composition. Furthermore, in order to allow Ga to be diffused into the grain boundary phase 14, it has been found important to diffuse Ga and Pr from the surface of the sintered magnet work into the interior by using a Ga-containing alloy having Pr as a main component.

As will be discussed with respect to the Examples below, when Nd is used instead of Pr, high $B_r$ and high $H_{cJ}$ are less likely to be obtained than when using Pr. This is presumably because, under the specific composition according to the present invention, Pr is easier to be diffused into the grain boundary phase 14 than is Nd. Stated otherwise, Pr is considered to have a higher ability to permeate into the grain boundary phase 14 than is Nd. Since Nd is also likely to permeate into the main phase 12, it is considered that, when an Nd—Ga alloy is used, some of Ga will also be diffused into the main phase 12.

According to an embodiment of the present invention, by using a Pr—Ga alloy, Pr and Ga can be diffused through grain boundaries while hardly being diffused into the main phase. Moreover, since the presence of Pr promotes diffusion through the grain boundaries, Ga can be diffused deep into the magnet interior. This is considered to provide high $B_r$ and high $H_{cJ}$.

2. Terminology (Sintered R-T-B Based Magnet Work and Sintered R-T-B Based Magnet)

In the present disclosure, a sintered R-T-B based magnet existing before the first heat treatment and during the first heat treatment will be referred to as a "sintered R-T-B based magnet work"; a sintered R-T-B based magnet existing after the first heat treatment, before the second heat treatment and during the second heat treatment will be referred to as a "sintered R-T-B based magnet work having undergone the first heat treatment"; and a sintered R-T-B based magnet existing after the second heat treatment will be simply referred to as a "sintered R-T-B based magnet".

(R-T-Ga Phase)

An R-T-Ga phase is a compound containing R, T and Ga, with its typical example being an $R_6T_{13}Ga$ compound. An $R_6T_{13}Ga$ compound has an $La_6Co_{11}Ga_3$ type crystal structure. An $R_6T_{13}Ga$ compound may take the state of an $R_6T_{13-}\delta Ga_{1+}\delta$ compound. When Cu, Al and Si are contained in the sintered R-T-B based magnet, the R-T-Ga phase may be $R_6T_{13-}\delta\ (Ga_{1-x-y-z}Cu_xAl_ySi_z)_{1+}\delta$.

3. Reasons for the Limited Composition, Etc.

A sintered R-T-B based magnet according to the present disclosure contains:

R: not less than 27.5 mass % and not more than 35.0 mass % (R is at least one rare-earth element which always includes Nd and Pr);

B: not less than 0.80 mass % and not more than 1.05 mass %;

Ga: not less than 0.05 mass % and not more than 1.0 mass %; and

M: not less than 0 mass % and not more than 2 mass % (where M is at least one of Cu, Al, Nb and Zr), and includes a balance T (where T is Fe, or Fe and Co) and impurities.

The B amount in the sintered R-T-B based magnet work is preferably in a range of not less than 0.80 mass % and not more than 0.99 mass %, and more preferably in a range of not less than 0.80 mass % and not more than 0.95 mass %, as this can provide even higher $H_{cJ}$. Moreover, the Ga amount in the sintered R-T-B based magnet work is preferably not less than 0.05 mass % and not more than 0.8 mass %.

(R)

The R content is not less than 27.5 mass % and not more than 35.0 mass %. R is at least one rare-earth element which always includes Nd. If R is less than 27.5 mass %, a liquid phase will not sufficiently occur in the sintering process, and it will be difficult for the sintered compact to become adequately dense in texture. On the other hand, if R exceeds 35.0 mass %, effects according to the present invention will be obtained, but the alloy powder during the production steps of the sintered compact will be very active, and considerable oxidization, ignition, etc. of the alloy powder may possibly occur; therefore, it is preferably 35 mass % or less. More preferably, R is not less than 28 mass % and not more than 33 mass %; and still more preferably, R is not less than 29 mass % and not more than 33 mass %. The content of the heavy rare-earth element RH (which is at least one of Dy and Tb, and may hereinafter be simply referred to as "RH") is preferably 5 mass % or less of the entire sintered R-T-B based magnet. Since an embodiment of the present invention is able to provide high $B_r$ and high $H_{cJ}$ without the use of an RH, the added amount of RH can be reduced even when higher $H_{cJ}$ is desired. More preferably, the RH content is 1 mass % or less. Furthermore preferably, it is not less than 0.05 mass % and not more than 0.30 mass %.

(B)

The B content is not less than 0.80 mass % and not more than 1.05 mass %. If the B content is less than 0.80 mass %, $B_r$ may possibly decrease; if the B content exceeds 1.05 mass %, $H_{cJ}$ may possibly decrease. Moreover, B may be partially replaced with C. The B content preferably satisfies inequality (1), which will be described in detail below, as this can provide even higher $H_{cJ}$.

(Ga)

The Ga content is not less than 0.05 mass % and not more than 1.0 mass %. If the Ga content is less than 0.05 mass %, high $H_{cJ}$ cannot be obtained. If it exceeds 1.0 mass %, high $B_r$ may not be obtained.

(M)

The M content is not less than 0 mass % and not more than 2 mass %. A sintered R-T-B based magnet according to the present disclosure may optionally contain the element M. The content of the element M within the sintered R-T-B based magnet is 0 mass %, or, more than 0 mass % but not more than 2 mass %. M is at least one of Cu, Al, Nb and Zr. Although effects of the present invention can be attained with 0 mass % of M, preferably there exists a total of 2 mass % or less of M. In particular, inclusion of Cu and/or Al will allow $H_{cJ}$ to be improved. Cu and/or Al may be intentionally added, or they may be allowed to be existent as they inevitably arrive in the raw materials used or in the production process of the alloy powder (a raw material(s) containing Cu and/or Al as impurities may be used). Inclusion of Nb and/or Zr will suppress abnormal grain growth of crystal grains during sintering. Preferably, M always includes Cu, such that Cu accounts for not less than 0.05 mass % and not more than 0.30 mass %, because inclusion of not less than 0.05 mass % and not more than 0.30 mass % of Cu will allow $H_{cJ}$ to be further improved.

(Balance T)

The balance is T (where T is Fe, or Fe and Co); in the present embodiment, T satisfies inequality (1), which will be described in detail below. Preferably, 90% or more of T by mass ratio is Fe. Fe may be partially replaced with Co. However, if the substituted amount of Co exceeds 10% of the entire T by mass ratio, $B_r$ will decrease, which is not preferable. Furthermore, a sintered R-T-B based magnet according to an embodiment of the present invention may contain impurities which will usually be present in alloys such as didymium alloys (Nd—Pr), electrolytic irons, or ferroborons, or in the production step, as well as small amounts of other elements. The entire content of impurities is preferably 2 mass % or less. Examples of impurity elements are Ti, V, Cr, Mn, Ni, Si, La, Ce, Sm, Ca, Mg, O (oxygen), N (carbon), C (nitrogen), Mo, Hf, Ta, W, Ag, Zn, In, Sn, Ge, Y, H, F, P, S and Ci. Among these, the respective preferable impurity contents are: 0.5 mass % or less for each of Ti, Ag, Zn, In and Sn; 0.2 mass % or less for each of La, Ce, Sm, Ca, Mg, Mn, Si, Cr, Ni, Mo, V, Hf, Ta, W, Ge and Y; and 500 ppm or less for H, F, P, S and Cl. It is 6000 ppm or less for 0; 1000 ppm or less for N; and 1500 ppm or less for C.

(Inequality (1))

In the present embodiment, preferably, inequality (1): [T]/55.85>14[B]/10.8 is satisfied, so that the B content is smaller than in commonly-used sintered R-T-B based magnets. In commonly-used sintered R-T-B based magnets, in order to prevent an Fe phase or an $R_2T_{17}$ phase from occurring in addition to the main phase, i.e., an $R_2T_{14}B$ phase, compositions are adopted such that [T]/55.85 (i.e., atomic weight of Fe) is smaller than 14[B]/10.8 (i.e., atomic weight of B), where [T] is the T content in mass %, and [B] is the B content in mass %. In a sintered R-T-B based magnet according to a preferable embodiment of the present disclosure, unlike in commonly-used sintered R-T-B based magnets, inequality (1) stipulates that [T]/55.85 (i.e., atomic weight of Fe) is greater than 14[B]/10.8 (i.e., atomic weight of B). The atomic weight of Fe is being relied upon because Fe is the main component of T in a sintered R-T-B based magnet according to an embodiment of the present invention.

Furthermore preferably, in a sintered R-T-B based magnet according to the present embodiment, the C concentration in an intergranular grain boundary that is located at a depth of 300 μm from the magnet surface is 2 mass % or less. High $H_{cJ}$ cannot be obtained if C is profusely contained in the intergranular grain boundary. Preferably, no C is contained in the intergranular grain boundary.

(Pr—Ga Alloy)

The Pr—Ga alloy is preferably such that Pr accounts for not less than 65 mass % and not more than 97 mass % of the entire Pr—Ga alloy; 20 mass % or less of Pr may be replaced with Nd; and 30 mass % or less of Pr may be replaced with an RH (which is at least one of Dy and Tb). Ga accounts for 3 mass % to 35 mass % of the entire Pr—Ga alloy, and 50 mass % or less of Ga can be replaced with Cu. The Pr—Ga alloy may contain impurities. In an embodiment of the present invention, that "20% or less of Pr can be replaced with Nd" means that, by defining the Pr content (mass %) in the Pr—Ga alloy to be 100%, 20% thereof can be replaced with Nd. For example, if Pr accounts for 65 mass % in the Pr—Ga alloy (and Ga accounts for 35 mass %), up to 13 mass % thereof may be replaced with Nd, thus resulting in 52 mass % Pr and 13 mass % Nd. The same is also true of Dy, Tb and Cu. By performing the below-described first heat treatment while keeping a Pr—Ga alloy containing Pr and Ga in the aforementioned ranges in contact with a sintered R-T-B based magnet work having a composition in the range according to an embodiment of the present invention, Ga is allowed to diffuse deep into the magnet interior through grain boundaries. An embodiment of the present invention is characterized by using a Ga-containing alloy having Pr as a main component. Although Pr can be replaced with Nd, Dy and/or Tb, it must be noted that high $B_r$ and high $H_{cJ}$ will not be obtained if their substituted amounts exceed the aforementioned ranges, because it will result in too little Pr. The Nd content in the Pr—Ga alloy is preferably 1 mass % or less. Although 50% or less of Ga may be replaced with Cu, $H_{cJ}$ may possibly decrease if the substituted amount of Cu exceeds 50%.

The shape and size of the Pr—Ga alloy are not particularly limited, and may be arbitrary. The Pr—Ga alloy may take the shape of a film, a foil, powder, a block, particles, or the like.

In the case where an RH (which is at least one of Dy and Tb) is to be contained in the sintered R-T-B based magnet, it is preferably introduced from the magnet surface via diffusion through the grain boundaries. In this case, an alloy obtained by allowing Pr in a Pr—Ga alloy to be partially replaced with an RH (Pr—RH—Ga alloy) may be used, or, for example, a Pr—Ga alloy and an RH compound may be allowed to be in contact with at least a portion of the surface of the sintered R-T-B based magnet work. The RH compound is at least one selected from among an RH fluoride, an RH oxide, and an RH oxyfluoride, which may be e.g., $TbF_3$, $DyF_3$, $Tb_2O_3$, $Dy_2O_3$, $Tb_4OF$, or $Dy_4OF$.

The shape and size of the RH compound are not particularly limited, and may be arbitrary. The RH compound may take the shape of a film, a foil, powder, a block, particles, or the like.

For example, in the case where 0.10 mass % of an RH is to be contained in the sintered R-T-B based magnet, as will be discussed in the Examples to be described later, a Pr—Ga alloy containing a specific amount (e.g. 6 mass %) of RH (Pr—RH—Ga alloy) may be placed in contact with a sintered R-T-B based magnet work which does not contain any RH to ensure that the RH content in the resultant sintered R-T-B based magnet will be 0.10 mass %. In the case where the sintered R-T-B based magnet work already contains an RH (e.g. 0.05 mass %), a total with an RH amount (e.g. 0.05 mass %) that is introduced from the magnet surface via diffusion through the grain boundaries by using a Pr—Ga alloy (Pr—RH—Ga alloy) may ensure that the RH content in the resultant sintered R-T-B based magnet will be 0.10 mass %.

4. Preparations (Step of Providing a Sintered R-T-B Based Magnet Work)

A sintered R-T-B based magnet work can be provided by using a generic method for producing a sintered R-T-B based magnet, such as an Nd—Fe—B based sintered magnet. As one example, a raw material alloy which is produced by a strip casting method or the like may be pulverized to not less than 3 μm and not more than 10 μm by using a jet mill or the like, thereafter pressed in a magnetic field, and then sintered at a temperature of not less than 900° C. and not more than 1100° C.

If the pulverized particle size (having a central value of volume as obtained by an airflow-dispersion laser diffraction method=D50) of the raw material alloy is less than 3 μm, it becomes very difficult to produce pulverized powder, thus resulting in a greatly reduced production efficiency, which is not preferable. On the other hand, if the pulverized particle size exceeds 10 μm, the sintered R-T-B based magnet work as finally obtained will have too large a crystal grain size to achieve high $H_{cJ}$, which is not preferable. So long as the aforementioned conditions are satisfied, the sintered R-T-B based magnet work may be produced from one kind of raw material alloy (a single raw-material alloy), or through a method of using two or more kinds of raw material alloys and mixing them (blend method).

(Step of Providing a Pr—Ga Alloy)

The Pr—Ga alloy may be provided by using any method of producing a raw material alloy that is adopted in the production methods of commonly-used sintered R-T-B based magnets, e.g., die-casting, strip casting, single-roll rapid quenching (melt spinning), atomization, or the like. Moreover, the Pr—Ga alloy may be what is obtained by pulverizing an alloy as obtained above with a known means of pulverization, e.g., a pin mill.

5. Heat Treatments (Step of Performing the First Heat Treatment)

While at least a portion of the Pr—Ga alloy is kept in contact with at least a portion of the surface of the sintered R-T-B based magnet work provided as described above, a heat treatment is performed in a vacuum or an inert gas ambient. In an embodiment of the present invention, this heat treatment is referred to as the first heat treatment. As a result of this, a liquid phase containing Pr and/or Ga occurs from the Pr—Ga alloy, and this liquid phase is introduced via diffusion from the surface of the sintered work into the interior, through grain boundaries in the sintered R-T-B based magnet work. As a result, not only Pr but also Ga is allowed to diffuse deep into the sintered R-T-B based magnet work, through the grain boundaries. The first heat treatment temperature is preferably a temperature which is above 600° C. but not higher than 950° C. If the first heat treatment temperature is 600° C. or less, the amount of liquid phase containing Pr and/or Ga may possibly be too little to attain high $H_{cJ}$; on the other hand, if the temperature exceeds 950° C., $H_{cJ}$ may possibly decrease. Furthermore preferably, the sintered R-T-B based magnet work having undergone the first heat treatment (above 600° C. but not higher than 940° C.) to be cooled down to 300° C. from the temperature at which the first heat treatment was conducted, with a cooling rate of 5° C./minute or more, as this can provide even higher $H_{cJ}$. Still more preferably, the cooling rate down to 300° C. is 15° C./minute or more.

The first heat treatment can be conducted by placing a Pr—Ga alloy of any arbitrary shape on the surface of the sintered R-T-B based magnet work, with a known heat treatment apparatus. For example, the surface of the sintered R-T-B based magnet work may be covered with a powder layer of Pr—Ga alloy, and the first heat treatment may be performed. For example, after applying a slurry obtained by allowing the Pr—Ga alloy to disperse in a dispersion medium onto the surface of the sintered R-T-B based magnet work, the dispersion medium may be evaporated so that the Pr—Ga alloy and the sintered R-T-B based magnet work can come into contact. Examples of the dispersion medium include alcohols (e.g., ethanol), aldehydes, and ketones.

Moreover, the Pr—Ga alloy is indifferent as to how it is positioned so long as at least a portion of the Pr—Ga alloy is in contact with at least a portion of the sintered R-T-B based magnet work; however, as will be discussed in the Examples described below, the Pr—Ga alloy is preferably placed at least in contact with a surface that is perpendicular to the alignment direction of the sintered R-T-B based magnet work. This will allow a liquid phase containing Pr and/or Ga to be more efficiently introduced via diffusion from the magnet surface into the interior. In this case, the Pr—Ga alloy may be in contact with the alignment direction of the sintered R-T-B based magnet work, or the Pr—Ga alloy may be in contact with the entire surface of the sintered R-T-B based magnet work.

As described earlier, in the case where the first heat treatment is performed while keeping a Pr—Ga alloy and an RH compound in contact with at least a portion of the surface of the sintered R-T-B based magnet work, for example, the Pr—Ga alloy and the RH compound may be separately placed on the sintered R-T-B based magnet surface, or a mixture obtained by mixing together the RH compound and the Pr—Ga alloy may be placed on the surface of the sintered R-T-B based magnet work.

In the case where the first heat treatment is performed by using a Pr—Ga alloy in which Pr is partially replaced with an RH or using such a Pr—Ga alloy and an RH compound, performing the first heat treatment will increase the RH content in the sintered R-T-B based magnet. It has been found in this context that the RH content in the finally-obtained sintered R-T-B based magnet may preferably be set in a very scarce and narrow range of not less than 0.05 mass % and not more than 0.30 mass %, whereby diffusion of RH into the magnet interior can be considerably promoted due to the action of the liquid phase containing Pr and Ga, thus resulting in a high effect of $H_{cJ}$ improvement. In other words, it has been found that, when a very small RH amount (not less than 0.05 mass % and not more than 0.30 mass %) is diffused into the magnet interior together with Pr and Ga, a very high effect of $H_{cJ}$ improvement can be obtained while reducing the amount of RH used.

In the sintered R-T-B based magnet thus obtained, the RH content is not less than 0.05 mass % and not more than 0.30 mass %, and the RH concentration in an outer crust of a main phase crystal grain that is located at a depth of 300 μm from the magnet surface is higher than the RH concentration in a central portion of the main phase crystal grain. That "the RH concentration in an outer crust of a main phase crystal grain is higher than the RH concentration in a central portion of the main phase crystal grain" means that the RH has been diffused into the magnet interior from the magnet surface. Moreover, the reason for stipulating a "main phase crystal grain that is located at a depth of 300 μm from the magnet surface" is that RH diffusion may be insufficient if the RH concentration in an outer crust of a main phase crystal grain that is only positioned less than 300 μm from the magnet surface (e.g. 200 μm from the magnet surface) is higher than the RH concentration in a central portion of the main phase crystal grain (i.e., at the position which is 300 μm deep the RH concentration in the outer crust is not higher than in the central portion), and thus a high effect of $H_{cJ}$ improvement may not be obtained. In order to ensure that the RH concentration in an outer crust of a main phase crystal grain that is located at a depth of 300 μm from the magnet surface is higher than the RH concentration in the central portion of the main phase crystal grain, various conditions may be adjusted, e.g., the heating temperature during diffusion (i.e., during the treatment), the amount of RH compound, the amount of Pr—Ga alloy, and the processing time. Among these, the amount of RH introduced (amount of increase) can be relatively easily controlled by adjusting the heating temperature during diffusion. The heating temperature during diffusion, for ensuring that the RH concentration in an outer crust of a main phase crystal grain that is located at a depth of 300 μm from the magnet surface is higher than the RH concentration in the central portion of the main phase crystal grain, is in the range of not higher than 700° C. and not lower than 950° C., and preferably in the range of not higher than 800° C. and not lower than 950° C. In the sintered R-T-B based magnet thus obtained (in which a very small RH amount (not less than 0.05 mass % and not more than 0.30 mass %) has been diffused into the magnet interior together with Pr and Ga), RH is also diffused from the magnet surface into the magnet interior, similarly to the cases of Ga and Pr; therefore, there exists a site in which the RH concentration gradually decreases from the magnet surface toward the interior. Existence of a site in which the RH concentration gradually decreases can be confirmed by a method similar to that used in the cases of gradually decreasing Ga and Pr concentrations.

That "the RH concentration in an outer crust of a main phase crystal grain that is located at a depth of 300 μm from the magnet surface is higher than the RH concentration in a central portion of the main phase crystal grain" may be confirmed as follows, for example. First, a crystal grain (a main phase crystal grain) in a magnet cross section of the sintered R-T-B based magnet is observed by using a transmission electron microscope (TEM). The place at which to observe the main phase crystal grain may be any arbitrary magnet cross section taken at 300 μm from the surface of the sintered R-T-B based magnet. Next, by using energy dispersive X-ray spectroscopy (EDX), a composition analysis is conducted as to the concentrations (mass %) of RH contained in a central portion and an outer crust of the main phase crystal grain. This makes it possible to confirm whether the RH concentration in the outer crust of the main phase crystal grain is higher than the RH concentration in the central portion of the main phase crystal grain. In the present disclosure, "an outer crust of a main phase crystal grain" means a range of 10 nm from an interface between the main phase crystal grain and a grain boundary phase (crystal grain boundary) that adjoins the main phase crystal grain, toward the central portion of the main phase crystal grain. Moreover, "a central portion of the main phase crystal grain" means the neighborhood of a center point (a range of about φ1 μm from the center point) of a cross section in the main phase crystal grain. So long as the outer crust of the main phase crystal grain that is located at a depth of 300 μm from the magnet surface includes a site in which the RH concentration is higher than in its central portion, it is said that "the RH concentration in an outer crust of a main phase crystal grain is higher than the RH concentration in a central portion of the main phase crystal grain". Furthermore, the present disclosure does not require that the RH concentration in an outer crust of every main phase crystal grain that is located at a depth of 300 μm from the magnet surface be higher than the RH concentration in a central portion of the main phase crystal grain. In order for the effects of the present disclosure to be attained, 20 main phase crystal grains may be randomly selected at the position which is 300 μm deep from the magnet surface, and it suffices if the RH concentration in an outer crust of the main phase crystal grain is higher than the RH concentration in the central portion of the main phase crystal grain with respect to 80% or more (i.e., 16 or more) of the selected main phase crystal grains.

(Step of Performing the Second Heat Treatment)

The sintered R-T-B based magnet work having undergone the first heat treatment is subjected to a heat treatment at a temperature which is lower than the temperature used in the step of performing the first heat treatment, in a vacuum or an inert gas ambient. In an embodiment of the present invention, this heat treatment is referred to as the second heat treatment. By performing the second heat treatment, an R-T-Ga phase is generated, whereby high $H_{cJ}$ can be obtained. The second heat treatment temperature is preferably not lower than 450° C. and not higher than 750° C. If the second heat treatment is at a temperature which is higher than that of the first heat treatment, or if the temperature of the second heat treatment is below 450° C. or above 750° C., the amount of generated R-T-Ga phase may be too small to obtain high $H_{cJ}$.

EXAMPLES

Example 1

[Providing Sintered R-T-B Based Magnet Work]

Raw materials of respective elements were weighed in order to obtain sintered R-T-B based magnet works having compositions approximately as indicated by Nos. A-1 and A-2 in Table 1, and alloys were produced by a strip casting method. Each resultant alloy was coarse-pulverized by a hydrogen pulverizing method, thereby obtaining a coarse-pulverized powder. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (raw material alloy powder) with a pulverized particle size D50 of 4 μm was obtained. To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction. In a vacuum, the resultant compact was sintered for 4 hours at not less than 1060° C. and not more than 1090° C. (for each sample, a temperature was selected at which a sufficiently dense texture would result through sintering), whereby a sintered R-T-B based magnet work was obtained. Each resultant sintered R-T-B based magnet work had a density of 7.5 $Mg/m^3$ or more. A component analysis of the resultant sintered R-T-B based magnet works is shown in Table 1. The respective components in Table 1 were measured by using Inductively Coupled Plasma Optical Emission Spectroscopy (ICP-OES). The sintered R-T-B based magnet works in the following Examples were also measured similarly. Moreover, "○" signifies inequality (1) according to the present invention being satisfied, and "X" signifies inequality (1) not being satisfied. The same is also true of Tables 5, 8, 10, 13, 15 and 18 below. Note that each composition in Table 1 does not total to 100 mass %. This is because components other than the components listed in Table 1 (e.g., O (oxygen), N (nitrogen), and the like) exist. The same is also true of Tables 5, 8, 10, 13, 15, 18, 21 and 24.

TABLE 1

| | composition of sintered R-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | ineq. (1) |
| A-1 | 30.0 | 0.0 | 0.0 | 0.0 | 0.89 | 0.1 | 0.1 | 0.0 | 0.0 | 0.0 | 1.0 | 67.1 | ○ |
| A-2 | 30.0 | 1.0 | 0.0 | 0.0 | 0.89 | 0.1 | 0.1 | 0.2 | 0.0 | 0.0 | 1.0 | 66.1 | ○ |

[Providing Pr—Ga Alloy]

Raw materials of the respective elements were weighed so as to result in a Pr—Ga alloy approximately having the composition shown in No. a-1 of Table 2, and these raw materials were melted; thus, by a single-roll rapid quenching technique (melt spinning technique), an alloy in ribbon or flake form was obtained. Using a mortar, the resultant alloy was pulverized in an argon ambient, and thereafter was passed through a sieve with an opening of 425 μm, thereby providing an Pr—Ga alloy. The composition of the resultant Pr—Ga alloy based alloy is shown in Table 2. Note that the respective components in Table 2 were measured by using Inductively Coupled Plasma Optical Emission Spectroscopy (ICP-OES). The respective components in the Pr—Ga alloys of the following Examples were also similarly measured.

TABLE 2

| | composition of Pr—Ga alloy (mass %) | |
|---|---|---|
| No. | Pr | Ga |
| a-1 | 89 | 11 |

[Heat Treatments]

The sintered R-T-B based magnet works of Nos. A-1 and A-2 in Table 1 were cut and ground into 7.4 mm×7.4 mm×7.4 mm cubes. Next, for the sintered R-T-B based magnet work of No. A-1, on its two faces which were perpendicular to the alignment direction, 3 parts by mass of the Pr—Ga alloy (No. a-1) was spread relative to 100 parts by mass of the sintered R-T-B based magnet work (i.e., 1.5 parts by mass per face). Thereafter, in argon which was controlled to a reduced pressure of 50 Pa, the first heat treatment was conducted for 4 hours at the temperature shown in Table 3, followed by a cooling to room temperature, whereby a sintered R-T-B based magnet work having undergone the first heat treatment was obtained. Furthermore, this sintered R-T-B based magnet work having undergone the first heat treatment and No. A-2 (i.e., a sintered R-T-B based magnet work which did not undergo the first heat treatment) were subjected to the second heat treatment for 3 hours at the temperature shown in Table 3 in argon which was controlled to a reduced pressure of 50 Pa, followed by a cooling to room temperature, whereby sintered R-T-B based magnets (Nos. 1 and 2) were produced. Note that the cooling (i.e., a cooling down to room temperature after performing the first heat treatment) was performed by introducing an argon gas into the furnace at a cooling rate such that an average cooling rate from the temperature of heat treatment (900° C.) to 300° C. was 25° C./minute. The average cooling rate (25° C./minute) had a variation in cooling rate (i.e., a difference between the highest value and the lowest value of the cooling rate) within 3° C./minute. For the sintered R-T-B based magnet of No. 1 thus obtained, in order to remove any thickened portion in the Pr—Ga alloy, a surface grinder was used to grind 0.2 mm off the entire surface of the respective sample, whereby a sample in the form of a 7.0 mm×7.0 mm×7.0 mm cube (sintered R-T-B based magnet) was obtained. The sintered R-T-B based magnet of No. 2 was also subjected to similar grinding, whereby a sample in the form of a 7.0 mm×7.0 mm×7.0 mm cube was obtained. The composition of the resultant sintered R-T-B based magnet of No. 1 (i.e., a sample to which Pr and/or Ga had been diffused by using the Pr—Ga alloy) was measured by using Inductively Coupled Plasma Optical Emission Spectroscopy (ICP-OES), which proved to be similar to that of No. 2 (i.e., the same composition as that of No. A-2 because No. 2 was not subjected to the Pr—Ga alloy).

TABLE 3

| | producing conditions | | | |
|---|---|---|---|---|
| No. | sintered R-T-B based magnet work | Pr—Ga alloy | first heat treatment | second heat treatment |
| 1 | A-1 | a-1 | 900° C. | 500° C. |
| 2 | A-2 | first heat treatment not performed | | 500° C. |

[Sample Evaluations]

$B_r$ and $H_{cJ}$ of the resultant samples were measured by using a B—H tracer. The measurement results are shown in Table 4.

TABLE 4

| No. | $B_r$ (T) | $H_{cJ}$ (kA/m) | Notes |
|---|---|---|---|
| 1 | 1.40 | 1520 | Inv. |
| 2 | 1.38 | 1250 | Comp. |

As mentioned above, although Nos. 1 and 2 were substantially identical in composition, the embodiment of the present invention (No. 1) exhibited higher $B_r$ and higher $H_{cJ}$, as indicated in Table 4. Including the below-described Examples, examples of the present invention all attained high magnetic characteristics of $B_r \geq 1.30$ T and $H_{cJ} \geq 1490$ kA/m.

Example 2

A sintered R-T-B based magnet work was produced by a method similar to that of Example 1, except for being blended so that the sintered R-T-B based magnet work approximately had the composition shown in No. B-1 of Table 5. A component analysis of the resultant sintered R-T-B based magnet work is shown in Table 5.

TABLE 5

| | composition of sintered R-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | ineq. (1) |
| B-1 | 24.0 | 7.0 | 0.0 | 0.0 | 0.88 | 0.1 | 0.1 | 0.2 | 0.0 | 0.0 | 1.0 | 67.1 | ○ |

A Pr—Ga alloy was produced by a method similar to that of Example 1, except for being blended so that the Pr—Ga alloy approximately had the compositions shown in Nos. b-1 and b-2 of Table 6. The compositions of the resultant Pr—Ga alloys are shown in Table 6.

TABLE 6

| | composition of Pr—Ga alloy (mass %) | | | |
|---|---|---|---|---|
| No. | Pr | Nd | Ga | Notes |
| b-1 | 89 | 0 | 11 | Inv. |
| b-2 | 0 | 89 | 11 | Comp. |

After processing the sintered R-T-B based magnet work (No. B-1) in a similar manner to Example 1, a Pr—Ga alloy and an Nd—Ga alloy were spread on the sintered R-T-B based magnet work in a similar manner to No. 1 of Example 1; the first heat treatment as shown in Table 7 was performed; and furthermore the sintered R-T-B based magnet work having undergone the first heat treatment was subjected to the second heat treatment as shown in Table 7, thereby producing sintered R-T-B based magnets (Nos. 3 and 4). The producing conditions (i.e., kinds of sintered R-T-B based magnet works and Pr—Ga alloys and temperatures of the first heat treatment and the second heat treatment) are shown in Table 7. Note that the cooling condition after the first heat treatment, down to room temperature, was similar to that in Example 1. A component analysis of the resultant sintered R-T-B based magnets is shown in Table 8.

TABLE 7

| | producing conditions | | | |
|---|---|---|---|---|
| No. | sintered R-T-B based magnet work | Pr—Ga alloy | first heat treatment | first heat treatment |
| 3 | B-1 | b-1 | 850° C. | 500° C. |
| 4 | B-1 | b-2 | 850° C. | 500° C. |

TABLE 8

| | composition of sintered R-T-B based magnet (mass %) | | | | | | | | | | | | ineq. | |
|---|---|---|---|---|---|---|---|---|---|---|---|---|---|---|
| No. | Nd | Pr | Dy | Tb | B | Cu | Al | Ga | Zr | Nb | Co | Fe | (1) | Notes |
| 3 | 24.0 | 8.4 | 0.0 | 0.0 | 0.88 | 0.1 | 0.1 | 0.4 | 0.0 | 0.0 | 1.0 | 65.7 | ○ | Inv. |
| 4 | 24.8 | 7.0 | 0.0 | 0.0 | 0.88 | 0.1 | 0.1 | 0.3 | 0.0 | 0.0 | 1.0 | 66.3 | ○ | Comp. |

The resultant samples were processed in a similar manner to Example 1, and measured by a similar method, thereby determining $B_r$ and $H_{cJ}$. The results are shown in Table 9.

TABLE 9

| No. | $B_r$ (T) | $H_{cJ}$ (kA/m) | Notes |
|---|---|---|---|
| 3 | 1.37 | 1620 | Inv. |
| 4 | 1.37 | 1320 | Comp. |

As indicated in Table 9, higher $H_{cJ}$ is obtained in No. 3, which is an embodiment of the present invention where a Pr—Ga alloy (No. b-1) is used, than in No. 4 where an Nd—Ga alloy (No. b-2) is used.

Example 3

A sintered R-T-B based magnet work was produced by a method similar to that of Example 1, except for being blended so that the sintered R-T-B based magnet work approximately had the compositions shown in Nos. C-1 to C-4 of Table 10. A component analysis of the resultant sintered R-T-B based magnet works is shown in Table 10.

TABLE 10

| | composition of sintered R-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | ineq. (1) |
| C-1 | 24.0 | 7.0 | 0.0 | 0.0 | 0.86 | 0.1 | 0.1 | 0.2 | 0.0 | 0.0 | 1.0 | 67.1 | ○ |
| C-2 | 24.0 | 7.0 | 0.0 | 0.0 | 0.88 | 0.1 | 0.1 | 0.2 | 0.0 | 0.0 | 1.0 | 67.1 | ○ |
| C-3 | 23.0 | 7.0 | 0.0 | 0.0 | 0.88 | 0.1 | 0.1 | 0.2 | 0.0 | 0.0 | 0.5 | 68.1 | ○ |
| C-4 | 24.0 | 7.0 | 0.0 | 0.0 | 0.84 | 0.1 | 0.2 | 0.0 | 0.0 | 0.0 | 1.0 | 67.1 | ○ |

A Pr—Ga alloy was produced by a method similar to that of Example 1, except for being blended so that the Pr—Ga alloy approximately had the compositions shown in Nos. c-1 to c-20 of Table 11. A component analysis of the resultant Pr—Ga alloys is shown in Table 11.

TABLE 11

| | composition of Pr—Ga alloy (mass %) | | | | | | |
|---|---|---|---|---|---|---|---|
| No. | Nd | Pr | Dy | Tb | Ga | Cu | Notes |
| c-1 | 0 | 60 | 0 | 0 | 40 | 0 | Comp. |
| c-2 | 0 | 65 | 0 | 0 | 35 | 0 | Inv. |
| c-3 | 0 | 80 | 0 | 0 | 20 | 0 | Inv. |
| c-4 | 0 | 89 | 0 | 0 | 11 | 0 | Inv. |
| c-5 | 0 | 97 | 0 | 0 | 3 | 0 | Inv. |
| c-6 | 0 | 100 | 0 | 0 | 0 | 0 | Comp. |
| c-7 | 9 | 80 | 0 | 0 | 11 | 0 | Inv. |
| c-8 | 17 | 72 | 0 | 0 | 11 | 0 | Inv. |
| c-9 | 15 | 70 | 0 | 0 | 15 | 0 | Inv. |
| c-10 | 20 | 69 | 0 | 0 | 11 | 0 | Comp. |
| c-11 | 0 | 79 | 0 | 10 | 11 | 0 | Inv. |
| c-12 | 0 | 63 | 0 | 26 | 11 | 0 | Inv. |
| c-13 | 0 | 79 | 10 | 0 | 11 | 0 | Inv. |

TABLE 11-continued

| | composition of Pr—Ga alloy (mass %) | | | | | | |
|---|---|---|---|---|---|---|---|
| No. | Nd | Pr | Dy | Tb | Ga | Cu | Notes |
| c-14 | 0 | 69 | 10 | 10 | 11 | 0 | Inv. |
| c-15 | 0 | 49 | 40 | 0 | 11 | 0 | Comp. |
| c-16 | 0 | 35 | 35 | 0 | 30 | 0 | Comp. |
| c-17 | 0 | 89 | 0 | 0 | 11 | 0 | Inv. |
| c-18 | 0 | 89 | 0 | 0 | 8 | 3 | Inv. |
| c-19 | 0 | 89 | 0 | 0 | 6 | 5 | Inv. |
| c-20 | 0 | 89 | 0 | 0 | 3 | 8 | Comp. |

After processing the sintered R-T-B based magnet works (Nos. C-1 to C-4) in a similar manner to Example 1, a Pr—Ga alloy was spread on the sintered R-T-B based magnet works in a similar manner to No. 1 of Example 1; the first heat treatment as shown in Table 12 was performed; and the sintered R-T-B based magnet works having undergone the first heat treatment were further subjected to the second heat treatment as shown in Table 12, thus producing sintered R-T-B based magnets (Nos. 5 to 25). The producing conditions (i.e., kinds of sintered R-T-B based magnet works and Pr—Ga alloys and temperatures of the first heat treatment and the second heat treatment) are shown in Table 12. Note that the cooling condition after the first heat treatment, down to room temperature, was similar to that in Example 1. A component analysis of the resultant sintered R-T-B based magnets is shown in Table 13.

TABLE 12

| | producing conditions | | | |
|---|---|---|---|---|
| No. | sintered R-T-B based magnet work | Pr—Ga alloy | first heat treatment | second heat treatment |
| 5 | C-1 | c-1 | 800° C. | 500° C. |
| 6 | C-1 | c-2 | 800° C. | 500° C. |
| 7 | C-1 | c-3 | 800° C. | 500° C. |
| 8 | C-1 | c-4 | 800° C. | 500° C. |
| 9 | C-1 | c-5 | 800° C. | 500° C. |
| 10 | C-1 | c-6 | 800° C. | 500° C. |
| 11 | C-2 | c-7 | 850° C. | 500° C. |
| 12 | C-2 | c-8 | 850° C. | 500° C. |
| 13 | C-2 | c-9 | 850° C. | 500° C. |
| 14 | C-2 | c-10 | 850° C. | 500° C. |
| 15 | C-3 | c-4 | 800° C. | 500° C. |
| 16 | C-3 | c-11 | 800° C. | 500° C. |
| 17 | C-3 | c-12 | 800° C. | 500° C. |

TABLE 12-continued

| No. | producing conditions | | | |
|---|---|---|---|---|
| | sintered R-T-B based magnet work | Pr—Ga alloy | first heat treatment | second heat treatment |
| 18 | C-3 | c-13 | 800° C. | 500° C. |
| 19 | C-3 | c-14 | 800° C. | 500° C. |
| 20 | C-3 | c-15 | 800° C. | 500° C. |
| 21 | C-3 | c-16 | 800° C. | 500° C. |
| 22 | C-4 | c-17 | 900° C. | 500° C. |
| 23 | C-4 | c-18 | 900° C. | 500° C. |
| 24 | C-4 | c-19 | 900° C. | 500° C. |
| 25 | C-4 | c-20 | 900° C. | 500° C. |

TABLE 13

| No. | composition of sintered R-T-B based magnet (mass %) | | | | | | | | | | | | ineq. | |
|---|---|---|---|---|---|---|---|---|---|---|---|---|---|---|
| | Nd | Pr | Dy | Tb | B | Cu | Al | Ga | Zr | Nb | Co | Fe | (1) | Notes |
| 5 | 24.0 | 7.3 | 0.0 | 0.0 | 0.86 | 0.1 | 0.1 | 0.3 | 0.0 | 0.0 | 1.0 | 66.8 | ○ | Comp. |
| 6 | 24.0 | 8.1 | 0.0 | 0.0 | 0.86 | 0.1 | 0.1 | 0.5 | 0.0 | 0.0 | 1.0 | 66.0 | ○ | Inv. |
| 7 | 24.0 | 8.2 | 0.0 | 0.0 | 0.86 | 0.1 | 0.1 | 0.4 | 0.0 | 0.0 | 1.0 | 65.9 | ○ | Inv. |
| 8 | 24.0 | 8.4 | 0.0 | 0.0 | 0.86 | 0.1 | 0.1 | 0.4 | 0.0 | 0.0 | 1.0 | 65.7 | ○ | Inv. |
| 9 | 24.0 | 8.8 | 0.0 | 0.0 | 0.86 | 0.1 | 0.1 | 0.3 | 0.0 | 0.0 | 1.0 | 65.3 | ○ | Inv. |
| 10 | 24.0 | 7.1 | 0.0 | 0.0 | 0.86 | 0.1 | 0.1 | 0.2 | 0.0 | 0.0 | 1.0 | 67.0 | ○ | Comp. |
| 11 | 24.1 | 8.1 | 0.0 | 0.0 | 0.88 | 0.1 | 0.1 | 0.4 | 0.0 | 0.0 | 1.0 | 65.9 | ○ | Inv. |
| 12 | 24.1 | 8.1 | 0.0 | 0.0 | 0.88 | 0.1 | 0.1 | 0.4 | 0.0 | 0.0 | 1.0 | 65.9 | ○ | Inv. |
| 13 | 24.1 | 8.0 | 0.0 | 0.0 | 0.88 | 0.1 | 0.1 | 0.4 | 0.0 | 0.0 | 1.0 | 66.0 | ○ | Inv. |
| 14 | 24.3 | 7.7 | 0.0 | 0.0 | 0.88 | 0.1 | 0.1 | 0.3 | 0.0 | 0.0 | 1.0 | 66.1 | ○ | Comp. |
| 15 | 23.0 | 8.4 | 0.0 | 0.0 | 0.88 | 0.1 | 0.1 | 0.4 | 0.0 | 0.0 | 0.5 | 65.7 | ○ | Inv. |
| 16 | 23.0 | 8.2 | 0.0 | 0.1 | 0.88 | 0.1 | 0.1 | 0.4 | 0.0 | 0.0 | 0.5 | 65.8 | ○ | Inv. |
| 17 | 23.0 | 8.0 | 0.0 | 0.3 | 0.88 | 0.1 | 0.1 | 0.4 | 0.0 | 0.0 | 0.5 | 65.8 | ○ | Inv. |
| 18 | 23.0 | 8.1 | 0.1 | 0.0 | 0.88 | 0.1 | 0.1 | 0.4 | 0.0 | 0.0 | 0.5 | 65.9 | ○ | Inv. |
| 19 | 23.0 | 8.0 | 0.1 | 0.1 | 0.88 | 0.1 | 0.1 | 0.4 | 0.0 | 0.0 | 0.5 | 65.9 | ○ | Inv. |
| 20 | 23.0 | 7.2 | 0.0 | 0.0 | 0.88 | 0.1 | 0.1 | 0.2 | 0.0 | 0.0 | 0.5 | 67.0 | ○ | Comp. |
| 21 | 23.0 | 7.1 | 0.0 | 0.0 | 0.88 | 0.1 | 0.1 | 0.2 | 0.0 | 0.0 | 0.5 | 67.1 | ○ | Comp. |
| 22 | 24.0 | 8.4 | 0.0 | 0.0 | 0.84 | 0.1 | 0.2 | 0.2 | 0.0 | 0.0 | 1.0 | 65.7 | ○ | Inv. |
| 23 | 24.0 | 8.2 | 0.0 | 0.0 | 0.84 | 0.2 | 0.2 | 0.2 | 0.0 | 0.0 | 1.0 | 65.9 | ○ | Inv. |
| 24 | 24.0 | 8.2 | 0.0 | 0.0 | 0.84 | 0.2 | 0.2 | 0.2 | 0.0 | 0.0 | 1.0 | 65.9 | ○ | Inv. |
| 25 | 24.0 | 7.7 | 0.0 | 0.0 | 0.84 | 0.5 | 0.2 | 0.0 | 0.0 | 0.0 | 1.0 | 66.4 | ○ | Comp. |

The resultant samples were processed in a similar manner to Example 1, and measured by a similar method, thereby determining $B_r$ and $H_{cJ}$. The results are shown in Table 14.

TABLE 14

| No. | $B_r$ (T) | $H_{cJ}$ (kA/m) | Notes |
|---|---|---|---|
| 5 | 1.36 | 1200 | Comp. |
| 6 | 1.36 | 1500 | Inv. |
| 7 | 1.36 | 1550 | Inv. |
| 8 | 1.36 | 1630 | Inv. |
| 9 | 1.36 | 1600 | Inv. |
| 10 | 1.35 | 1250 | Comp. |
| 11 | 1.37 | 1600 | Inv. |
| 12 | 1.37 | 1580 | Inv. |
| 13 | 1.37 | 1490 | Inv. |
| 14 | 1.37 | 1370 | Comp. |
| 15 | 1.37 | 1630 | Inv. |
| 16 | 1.37 | 1700 | Inv. |
| 17 | 1.37 | 1790 | Inv. |
| 18 | 1.37 | 1650 | Inv. |
| 19 | 1.37 | 1730 | Inv. |
| 20 | 1.37 | 1250 | Comp. |
| 21 | 1.37 | 1230 | Comp. |
| 22 | 1.34 | 1580 | Inv. |
| 23 | 1.34 | 1550 | Inv. |
| 24 | 1.34 | 1550 | Inv. |
| 25 | 1.34 | 1280 | Comp. |

As indicated in Table 14, Nos. 6 to 9, 11 to 13, Nos. 15 to 19, and Nos. 22 to 24, which are embodiments of the present invention, attain high magnetic characteristics of $B_r \geq 1.30$ T and $H_{cJ} \geq 1490$ kA/m. On the other hand, Nos. 5 and 10, where the Pr and Ga contents in the Pr—Ga alloy are outside the ranges according to the present invention, and Nos. 14, 20 and 21, where the amounts of Nd and Dy substituted for Pr in the Pr—Ga alloy are outside the ranges according to the present invention, and No. 25, where the amount of Cu substituted for Ga in the Pr—Ga alloy is outside the range according to the present invention, fail to attain the high magnetic characteristics of $B_r \geq 1.30$ T and $H_{cJ} \geq 1490$ kA/m.

Example 4

A sintered R-T-B based magnet work was produced by a method similar to that of Example 1, except for being blended so that the sintered R-T-B based magnet work had the compositions shown in Nos. D-1 to D-16 of Table 15. A component analysis of the resultant sintered R-T-B based magnet works is shown in Table 15.

TABLE 15

| | composition of sintered R-T-B based magnet work (mass %) | | | | | | | | | | | | | |
|---|---|---|---|---|---|---|---|---|---|---|---|---|---|---|
| No. | Nd | Pr | Dy | Tb | B | Cu | Al | Ga | Zr | Nb | Co | Fe | ineq. (1) | Notes |
| D-1 | 24.0 | 7.0 | 0.0 | 0.0 | 0.98 | 0.1 | 0.2 | 0.3 | 0.0 | 0.0 | 1.0 | 66.4 | X | Comp. |
| D-2 | 24.0 | 7.0 | 0.0 | 0.0 | 0.90 | 0.1 | 0.2 | 0.3 | 0.0 | 0.0 | 1.0 | 66.5 | ○ | Inv. |
| D-3 | 24.0 | 7.0 | 0.0 | 0.0 | 0.85 | 0.1 | 0.2 | 0.3 | 0.0 | 0.0 | 1.0 | 66.6 | ○ | Inv. |
| D-4 | 24.0 | 7.0 | 0.0 | 0.0 | 0.80 | 0.1 | 0.2 | 0.3 | 0.0 | 0.0 | 1.0 | 66.6 | ○ | Inv. |
| D-5 | 24.0 | 7.0 | 0.0 | 0.0 | 0.78 | 0.1 | 0.2 | 0.3 | 0.0 | 0.0 | 1.0 | 66.6 | ○ | Inv. |
| D-6 | 27.0 | 8.0 | 0.0 | 0.0 | 0.87 | 0.1 | 0.2 | 0.3 | 0.0 | 0.0 | 1.0 | 62.5 | ○ | Inv. |
| D-7 | 30.0 | 0.0 | 0.0 | 0.0 | 0.87 | 0.1 | 0.2 | 0.0 | 0.0 | 0.0 | 1.0 | 67.8 | ○ | Inv. |
| D-8 | 17.0 | 13.0 | 0.0 | 0.0 | 0.87 | 0.1 | 0.2 | 0.0 | 0.0 | 0.0 | 1.0 | 67.8 | ○ | Inv. |
| D-9 | 24.0 | 9.0 | 0.5 | 0.0 | 0.88 | 0.2 | 0.2 | 0.0 | 0.0 | 0.0 | 1.0 | 64.3 | ○ | Inv. |
| D-10 | 24.0 | 9.0 | 0.5 | 0.0 | 0.88 | 0.2 | 0.2 | 0.2 | 0.0 | 0.0 | 1.0 | 64.1 | ○ | Inv. |
| D-11 | 24.0 | 9.0 | 0.5 | 0.0 | 0.88 | 0.2 | 0.2 | 0.3 | 0.0 | 0.0 | 1.0 | 64.0 | ○ | Inv. |
| D-12 | 24.0 | 9.0 | 0.5 | 0.0 | 0.88 | 0.2 | 0.2 | 0.5 | 0.0 | 0.0 | 1.0 | 63.8 | ○ | Inv. |
| D-13 | 24.0 | 9.0 | 0.5 | 0.0 | 0.88 | 0.2 | 0.2 | 0.8 | 0.0 | 0.0 | 1.0 | 63.5 | ○ | Inv. |
| D-14 | 24.0 | 9.0 | 0.5 | 0.0 | 0.88 | 0.2 | 0.2 | 1.2 | 0.0 | 0.0 | 1.0 | 63.1 | ○ | Comp. |
| D-15 | 24.0 | 7.0 | 0.0 | 1.0 | 0.88 | 0.2 | 0.1 | 0.3 | 0.2 | 0.0 | 1.0 | 65.4 | ○ | Inv. |
| D-16 | 24.0 | 7.0 | 0.0 | 1.0 | 0.88 | 0.2 | 0.1 | 0.3 | 0.0 | 0.5 | 1.0 | 65.1 | ○ | Inv. |

A Pr—Ga alloy was produced by a method similar to that of Example 1, except for being blended so that the Pr—Ga alloy had the composition shown in d-1 of Table 16. A component analysis of the resultant Pr—Ga alloy is shown in Table 16.

TABLE 16

| | composition of Pr—Ga alloy (mass %) | |
|---|---|---|
| No. | Pr | Ga |
| d-1 | 89 | 11 |

After processing the sintered R-T-B based magnet works (Nos. D-1 to D-16) in a similar manner to Example 1, a Pr—Ga alloy was spread on the sintered R-T-B based magnet works in a similar manner to No. 1 of Example 1; the first heat treatment as shown in Table 17 was performed; and the sintered R-T-B based magnet works having undergone the first heat treatment were further subjected to the second heat treatment as shown in Table 17, thus producing sintered R-T-B based magnets (Nos. 26 to 41). The producing conditions (i.e., kinds of sintered R-T-B based magnet works and Pr—Ga alloys and temperatures of the first heat treatment and the second heat treatment) are shown in Table 17. Note that the cooling condition after the first heat treatment, down to room temperature, was similar to that in Example 1. A component analysis of the resultant sintered R-T-B based magnets is shown in Table 18.

TABLE 17

| | producing conditions | | | |
|---|---|---|---|---|
| No. | sintered R-T-B based magnet work | Pr—Ga alloy | first heat treatment | second heat treatment |
| 26 | D-1 | d-1 | 900° C. | 500° C. |
| 27 | D-2 | d-1 | 900° C. | 500° C. |
| 28 | D-3 | d-1 | 900° C. | 500° C. |
| 29 | D-4 | d-1 | 900° C. | 500° C. |
| 30 | D-5 | d-1 | 900° C. | 500° C. |
| 31 | D-6 | d-1 | 900° C. | 500° C. |
| 32 | D-7 | d-1 | 900° C. | 500° C. |
| 33 | D-8 | d-1 | 900° C. | 500° C. |
| 34 | D-9 | d-1 | 900° C. | 500° C. |
| 35 | D-10 | d-1 | 900° C. | 500° C. |
| 36 | D-11 | d-1 | 900° C. | 500° C. |
| 37 | D-12 | d-1 | 900° C. | 500° C. |
| 38 | D-13 | d-1 | 900° C. | 500° C. |
| 39 | D-14 | d-1 | 900° C. | 500° C. |
| 40 | D-15 | d-1 | 900° C. | 500° C. |
| 41 | D-16 | d-1 | 900° C. | 500° C. |

TABLE 18

| | composition of sintered R-T-B based magnet (mass %) | | | | | | | | | | | | ineq. | |
|---|---|---|---|---|---|---|---|---|---|---|---|---|---|---|
| No. | Nd | Pr | Dy | Tb | B | Cu | Al | Ga | Zr | Nb | Co | Fe | (1) | Notes |
| 26 | 24.0 | 7.8 | 0.0 | 0.0 | 0.98 | 0.1 | 0.2 | 0.4 | 0.0 | 0.0 | 1.0 | 65.5 | X | Comp. |
| 27 | 24.0 | 8.2 | 0.0 | 0.0 | 0.90 | 0.1 | 0.2 | 0.5 | 0.0 | 0.0 | 1.0 | 65.3 | ○ | Inv. |
| 28 | 24.0 | 8.1 | 0.0 | 0.0 | 0.85 | 0.1 | 0.2 | 0.5 | 0.0 | 0.0 | 1.0 | 65.5 | ○ | Inv. |
| 29 | 24.0 | 8.3 | 0.0 | 0.0 | 0.80 | 0.1 | 0.2 | 0.5 | 0.0 | 0.0 | 1.0 | 65.3 | ○ | Inv. |
| 30 | 24.0 | 8.2 | 0.0 | 0.0 | 0.78 | 0.1 | 0.2 | 0.5 | 0.0 | 0.0 | 1.0 | 65.4 | ○ | Inv. |
| 31 | 27.0 | 9.1 | 0.0 | 0.0 | 0.87 | 0.1 | 0.2 | 0.5 | 0.0 | 0.0 | 1.0 | 61.4 | ○ | Inv. |
| 32 | 30.0 | 1.5 | 0.0 | 0.0 | 0.87 | 0.1 | 0.2 | 0.3 | 0.0 | 0.0 | 1.0 | 65.7 | ○ | Inv. |
| 33 | 17.0 | 14.4 | 0.0 | 0.0 | 0.87 | 0.1 | 0.2 | 0.3 | 0.0 | 0.0 | 1.0 | 66.4 | ○ | Inv. |
| 34 | 24.0 | 10.2 | 0.5 | 0.0 | 0.88 | 0.2 | 0.2 | 0.2 | 0.0 | 0.0 | 1.0 | 63.1 | ○ | Inv. |
| 35 | 24.0 | 10.1 | 0.5 | 0.0 | 0.88 | 0.2 | 0.2 | 0.4 | 0.0 | 0.0 | 1.0 | 63.0 | ○ | Inv. |
| 36 | 24.0 | 10.1 | 0.5 | 0.0 | 0.88 | 0.2 | 0.2 | 0.5 | 0.0 | 0.0 | 1.0 | 63.0 | ○ | Inv. |
| 37 | 24.0 | 10.2 | 0.5 | 0.0 | 0.88 | 0.2 | 0.2 | 0.7 | 0.0 | 0.0 | 1.0 | 62.6 | ○ | Inv. |
| 38 | 24.0 | 10.1 | 0.5 | 0.0 | 0.88 | 0.2 | 0.2 | 1.0 | 0.0 | 0.0 | 1.0 | 62.4 | ○ | Inv. |

TABLE 18-continued

| | composition of sintered R-T-B based magnet (mass %) | | | | | | | | | | | | ineq. | |
|---|---|---|---|---|---|---|---|---|---|---|---|---|---|---|
| No. | Nd | Pr | Dy | Tb | B | Cu | Al | Ga | Zr | Nb | Co | Fe | (1) | Notes |
| 39 | 24.0 | 9.9 | 0.5 | 0.0 | 0.88 | 0.2 | 0.2 | 1.2 | 0.0 | 0.0 | 1.0 | 62.2 | ○ | Comp. |
| 40 | 24.0 | 8.4 | 0.0 | 1.0 | 0.88 | 0.2 | 0.1 | 0.5 | 0.2 | 0.0 | 1.0 | 64.0 | ○ | Inv. |
| 41 | 24.0 | 8.4 | 0.0 | 1.0 | 0.88 | 0.2 | 0.1 | 0.5 | 0.0 | 0.5 | 1.0 | 63.7 | ○ | Inv. |

The resultant samples were processed in a similar manner to Example 1, and measured by a similar method, thereby determining $B_r$ and $H_{cJ}$. The results are shown in Table 19.

TABLE 19

| No. | $B_r$ (T) | $H_{cJ}$ (kA/m) | Notes |
|---|---|---|---|
| 26 | 1.40 | 900 | Comp. |
| 27 | 1.37 | 1570 | Inv. |
| 28 | 1.36 | 1600 | Inv. |
| 29 | 1.34 | 1580 | Inv. |
| 30 | 1.33 | 1550 | Inv. |
| 31 | 1.30 | 1750 | Inv. |
| 32 | 1.39 | 1530 | Inv. |
| 33 | 1.37 | 1700 | Inv. |
| 34 | 1.34 | 1700 | Inv. |
| 35 | 1.34 | 1730 | Inv. |
| 36 | 1.34 | 1750 | Inv. |
| 37 | 1.32 | 1680 | Inv. |
| 38 | 1.31 | 1600 | Inv. |
| 39 | 1.29 | 1580 | Comp. |
| 40 | 1.36 | 1810 | Inv. |
| 41 | 1.36 | 1830 | Inv. |

As indicated in Table 19, Nos. 27 to 38, and Nos. 40 and 41, which are embodiments of the present invention, attain high magnetic characteristics of $B_r \geq 1.30$ T and $H_{cJ} \geq 1490$ kA/m. On the other hand, No. 26, where the composition of the sintered R-T-B based magnet does not satisfy inequality (1) according to the present invention, and No. 39, where the Ga content in the sintered R-T-B based magnet is outside the range according to the present invention, fail to attain the high magnetic characteristics of $B_r \geq 1.30$ T and $H_{cJ} \geq 1490$ kA/m. Moreover, as is evident from Nos. 34 to 38 (where the Ga content in the sintered R-T-B based magnet work is 0.2 mass % to 1.0 mass %), the Ga content in the sintered R-T-B based magnet is preferably 0.5 mass % or less, whereby higher $H_{cJ}$ ($H_{cJ} \geq 1700$ kA/m) is achieved.

Example 5

For Nos. 1 to 5, 10, 14 and 17 in the above Examples, "a Pr/Nd which is a ratio of a concentration of Pr to a concentration of Nd in a central portion of a main phase crystal grain that is located at a depth of 300 μm from the magnet surface" and "a Pr/Nd which is a ratio of a concentration of Pr to a concentration of Nd in an intergranular grain boundary that is located at a depth of 300 μm from the magnet surface" were determined. Furthermore, it was confirmed whether "there exists a portion in which the Ga concentration from the magnet surface toward the magnet interior gradually decreases" or not. Specifically, this was carried out as follows. In Nos. 1 to 5, 10, 14 and 17, a crystal grain (a main phase crystal grain) and an intergranular grain boundary at 300 μm from the magnet surface (which herein was a plane perpendicular to the direction of magnetization) were observed by using a transmission electron microscope (TEM), and Nd and Pr concentrations as contained in the central portion of the main phase crystal grain and the intergranular grain boundary (which may be anywhere in the intergranular grain boundary) were measured by using dispersive X-ray spectroscopy (EDX), thereby determining Pr/Nd in the central portion of the main phase crystal grain and the intergranular grain boundary. The measurement results and the calculation results are shown in Table 20. Furthermore, in a magnet cross section of Nos. 1 to 5, 10, 14 and 17, an extent from the magnet surface to near the magnet center (at least 200 μm) in the depth direction was subjected to a line analysis by the aforementioned EDX, thus to confirm whether the Ga concentration gradually decreased from the magnet surface toward the magnet central portion (i.e., whether the concentration became gradually lower) or not. This is shown in Table 20, either as ○ to indicate that the Ga concentration gradually decreased, or X to indicated that it did not gradually decrease.

TABLE 20

| | | concentrations at central portion of main phase crystal grain and at intergranular grain boundary (mass %) | | | | | | | gradually decreasing | |
|---|---|---|---|---|---|---|---|---|---|---|
| No. | measurement point | Nd | Pr | Tb | Fe | Ga | C | Pr/Nd | Ga | Notes |
| 1 | central portion of main phase crystal grain | 25.1 | 0 | 0 | 70.6 | 0 | 0.1 | 0.00 | ○ | Inv. |
| | intergranular grain boundary | 34.1 | 39.3 | 0 | 5.4 | 9.1 | 0.2 | 1.15 | | |
| 3 | central portion of main phase crystal grain | 20.5 | 7.8 | 0 | 69.4 | 0 | 0.3 | 0.38 | ○ | Inv. |
| | intergranular grain boundary | 19.6 | 33.5 | 0 | 36.9 | 4.3 | 0.4 | 1.71 | | |
| 17 | central portion of main phase crystal grain | 19.2 | 7.2 | 0 | 71.7 | 0.1 | 0.5 | 0.38 | ○ | Inv. |
| | intergranular grain boundary | 33.1 | 38.8 | 0.9 | 5.8 | 8.2 | 0.9 | 1.17 | | |

TABLE 20-continued

| No. | measurement point | concentrations at central portion of main phase crystal grain and at intergranular grain boundary (mass %) Nd | Pr | Tb | Fe | Ga | C | Pr/Nd | gradually decreasing Ga | Notes |
|---|---|---|---|---|---|---|---|---|---|---|
| 2 | central portion of main phase crystal grain | 25.5 | 0 | 0 | 70.6 | 0.2 | 0.1 | 0.00 | X | Comp. |
| | intergranular grain boundary | 88.2 | 0 | 0 | 2.6 | 0.2 | 0.2 | 0.00 | | |
| 4 | central portion of main phase crystal grain | 20.5 | 8 | 0 | 69.2 | 0.3 | 0.2 | 0.39 | ○ | Comp. |
| | intergranular grain boundary | 47.4 | 35.2 | 0 | 10.5 | 0 | 0.5 | 0.74 | | |
| 5 | central portion of main phase crystal grain | 20.7 | 7.5 | 0 | 69.4 | 0.3 | 0.2 | 0.36 | ○ | Comp. |
| | intergranular grain boundary | 47 | 37.2 | 0 | 10.5 | 0.2 | 0.4 | 0.79 | | |
| 10 | central portion of main phase crystal grain | 21 | 8.2 | 0 | 68.9 | 0.3 | 0.2 | 0.39 | X | Comp. |
| | intergranular grain boundary | 47 | 35.5 | 0 | 10.5 | 0 | 0.6 | 0.76 | | |
| 14 | central portion of main phase crystal grain | 20.5 | 7.3 | 0 | 69 | 0.3 | 0.2 | 0.36 | ○ | Comp. |
| | intergranular grain boundary | 42.3 | 40.1 | 0 | 10.5 | 0.2 | 0.4 | 0.95 | | |

As indicated in Table 20, in all examples of the present invention (Nos. 1, 3 and 17), a Pr/Nd which is a ratio of a concentration of Pr to a concentration of Nd in a central portion of a main phase crystal grain that is located at a depth of 300 μm from the magnet surface is lower than 1; a Pr/Nd which is a ratio of a concentration of Pr to a concentration of Nd in an intergranular grain boundary that is located at a depth of 300 μm from the magnet surface is higher than 1; and there exists a portion in which the Ga concentration gradually decreases from the magnet surface toward the magnet interior (at least 200 μm). On the other hand, in No. 2, for which diffusion was not performed, No. 4, for which diffusion was performed by using an Nd—Ga alloy, sample No. 5, in which the Pr—Ga alloy had little Pr content, No. 10, for which diffusion was performed by using a Pr alloy (i.e., not containing Ga), and No. 14, in which the Pr—Ga alloy had much Nd content: a Pr/Nd which is a ratio of a Pr concentration to an Nd concentration in the intergranular grain boundary may be lower than 1, and the Ga concentration may not gradually decrease from the magnet surface toward the magnet interior.

Example 6

A sintered R-T-B based magnet work was produced by a method similar to that of Example 1, except for being blended so that the sintered R-T-B based magnet work approximately had the composition shown in No. E-1 of Table 21. A component analysis of the resultant sintered R-T-B based magnet work is shown in Table 21. For reference sake, a single resultant sintered R-T-B based magnet work was subjected to the second heat treatment (500° C.) alone, and its $B_r$ and $H_{cJ}$ were measured by using a B—H tracer, which revealed $B_r$: 1.39T, $H_{cJ}$: 1385 kA/m.

TABLE 21

| No. | composition of sintered R-T-B based magnet work (mass %) Nd | Pr | Dy | Tb | B | Cu | Al | Ga | Zr | Nb | Co | Fe | ineq. (1) |
|---|---|---|---|---|---|---|---|---|---|---|---|---|---|
| E-1 | 24.0 | 6.0 | 0.0 | 0.0 | 0.89 | 0.1 | 0.1 | 0.3 | 0.0 | 0.0 | 1.0 | 68.6 | ○ |

A Pr—Ga alloy was produced by a method similar to that of Example 1, except for being blended so that the Pr—Ga alloy had the compositions shown in e-1 to e-5 of Table 22. A component analysis of the resultant Pr—Ga alloys is shown in Table 22.

TABLE 22

| No. | composition of Pr—Ga alloy (mass %) Tb | Pr | Ga |
|---|---|---|---|
| e-1 | 3 | 86 | 11 |
| e-2 | 6 | 83 | 11 |
| e-3 | 9 | 80 | 11 |
| e-4 | 24 | 65 | 11 |
| e-5 | 8 | 81 | 11 |

After processing the sintered R-T-B based magnet work (No. E-1) in a similar manner to Example 1, a Pr—Ga alloy was spread on the sintered R-T-B based magnet work in a similar manner to No. 1 of Example 1; the first heat treatment as shown in Table 23 was performed; and the sintered R-T-B based magnet work having undergone the first heat treatment was further subjected to the second heat treatment as shown in Table 23, thus producing sintered R-T-B based magnets (Nos. 45 to 49). The producing conditions (i.e., kinds of sintered R-T-B based magnet works and Pr—Ga alloys and temperatures of the first heat treatment and the second heat treatment) are shown in Table 23. Note that the cooling condition after the first heat treatment, down to room temperature, was similar to that in Example 1. Components of the resultant sintered R-T-B based magnets were measured by a method similar to that of Example 1. The results are shown in Table 24.

TABLE 23

| | producing conditions | | | |
|---|---|---|---|---|
| No. | sintered R-T-B based magnet work | Pr—Ga alloy | first heat treatment | second heat treatment |
| 45 | E-1 | e-1 | 900 | 500 |
| 46 | E-1 | e-2 | 900 | 500 |
| 47 | E-1 | e-3 | 900 | 500 |
| 48 | E-1 | e-4 | 900 | 500 |
| 49 | E-1 | e-5 | 500 | 450 |

TABLE 24

| | composition of sintered R-T-B based magnet (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | ineq. (1) |
| 45 | 24.0 | 6.0 | 0.0 | 0.05 | 0.89 | 0.1 | 0.1 | 0.3 | 0.0 | 0.0 | 1.0 | 68.6 | ○ |
| 46 | 24.0 | 6.0 | 0.0 | 0.10 | 0.89 | 0.1 | 0.1 | 0.3 | 0.0 | 0.0 | 1.0 | 68.5 | ○ |
| 47 | 24.0 | 6.0 | 0.0 | 0.15 | 0.89 | 0.1 | 0.1 | 0.3 | 0.0 | 0.0 | 1.0 | 68.5 | ○ |
| 48 | 24.0 | 6.0 | 0.0 | 0.40 | 0.89 | 0.1 | 0.1 | 0.3 | 0.0 | 0.0 | 1.0 | 68.2 | ○ |
| 49 | 24.0 | 6.0 | 0.0 | 0.02 | 0.89 | 0.1 | 0.1 | 0.3 | 0.0 | 0.0 | 1.0 | 68.2 | ○ |

The resultant samples were measured by a method similar to that of Example 1 to determine $B_r$ and $H_{cJ}$. The results are shown in Table 25. Moreover, amounts of $H_{cJ}$ improvement are indicated at $\Delta H_{cJ}$ of Table 25. In Table 25, $\Delta H_{cJ}$ is obtained by subtracting from the $H_{cJ}$ values of Nos. 45 to 49 the $H_{cJ}$ (1385 kA/m) value of the sintered R-T-B based magnet work before the diffusion (i.e., after the heat treatment at 500° C.)

TABLE 25

| No. | $B_r$ (T) | $H_{cJ}$ (kA/m) | $\Delta H_{cJ}$ (kA/m) | Notes |
|---|---|---|---|---|
| 45 | 1.38 | 1785 | 400 | Inv. |
| 46 | 1.38 | 1800 | 415 | Inv. |
| 47 | 1.38 | 1810 | 425 | Inv. |
| 48 | 1.37 | 1815 | 430 | Inv. |
| 49 | 1.38 | 1425 | 400 | Comp. |

As indicated in Table 25, in all examples of the present invention (Nos. 45 to 48) where RH was diffused together with RL and Ga, such that RH increased by 0.05 mass % to 0.40 mass % through diffusion, $\Delta H_{cJ}$ was very high, i.e., 400 kA/m or more, and high $B_r$ and high $H_{cJ}$ were obtained. On the other hand, Comparative Example (No. 49) for which the first temperature was at 500° C., did not attain high $H_{cJ}$. Furthermore, RH was hardly introduced, as is indicated by the RH(Tb) content of 0.02 mass % in the finally-obtained sintered R-T-B based magnet, and $\Delta H_{cJ}$ is also low. Moreover, as indicated by Nos. 45 to 48 of Tables 24 and 25, the amount of $H_{cJ}$ improvement becomes gradually lower as RH increases from 0.05 mass % to 0.40 mass % (from No. 45 to No. 48). In other words, from No. 45 (where RH(Tb) accounts for 0.05 mass %) to No. 46 (where RH accounts for 0.10 mass %), $\Delta H_{cJ}$ is improved by 15 kA/m for a 0.05 mass % increase in the amount of RH introduced; from No. 46 (where RH accounts for 0.10 mass %) to No. 47 (where RH accounts for 0.15 mass %), $\Delta H_{cJ}$ is improved by 10 kA/m for a 0.05 mass % increase in the amount of RH introduced; furthermore, from No. 47 (where RH accounts for 0.15 mass %) to No. 48 (0.40 mass %), $\Delta H_{cJ}$ is only improved by 5 kA/m for a 0.25 mass % increase in the amount of RH introduced. Thus, the amount of $H_{cJ}$ improvement becomes gradually lower. Therefore, when the amount of RH introduced exceeds 0.40 mass %, the effect of $H_{cJ}$ improvement will be so low that it may not be possible to obtain high $B_r$ and high $H_{cJ}$ while reducing the amount of RH used.

Example 7

For No. 17 in the above Examples, it was confirmed whether there exists "a portion in which the Ga concentration gradually decreases from the magnet surface toward the magnet interior". Furthermore, it was confirmed whether "the RH concentration in an outer crust of a main phase crystal grain that is located at a depth of 300 μm from the magnet surface is higher than the RH concentration in a central portion of the main phase crystal grain" or not. Specifically, this was carried out as follows. In a magnet cross section of No. 17, an extent from the magnet surface to near the magnet center (at least 200 μm) was subjected to a line analysis by the aforementioned EDX, thus to confirm whether the Ga concentration gradually decreased from the magnet surface toward the magnet central portion (i.e., whether the concentration became gradually lower) or not. This is respectively shown in Table 26, either as ○ to indicate that the Ga concentration gradually decreased, or X to indicated that it did not gradually decrease.

Furthermore, in No. 17, a crystal grain (a main phase crystal grain) at 300 μm from the magnet surface (which herein was a plane perpendicular to the direction of magnetization) was observed by using a transmission electron microscope (TEM); and, by using dispersive X-ray spectroscopy (EDX), RH concentrations (Tb and Dy) as contained in an outer crust of the main phase crystal grain (i.e., a range of 10 nm from an interface between the main phase crystal grain and a grain boundary phase (crystal grain boundary) that adjoins the main phase crystal grain toward a central portion of the main phase crystal grain) and in the central portion were measured. The measurement results are shown in Table 26.

TABLE 26

| No | 300 μm deep from magnet surface: RH concentration in outer crust of main phase crystal grain (mass %) | 300 μm deep from magnet surface: RH concentration in central portion of main phase crystal grain (mass %) | gradually decreasing Ga | Notes |
|---|---|---|---|---|
| 17 | 4.0 | 0 | ○ | Inv. |

As indicated in Table 26, the example of the present invention (No. 17) includes a portion in which the Ga concentration gradually decreases from the magnet surface toward the magnet interior, and the RH concentration in an outer crust of a main phase crystal grain that is located at a depth of 300 μm from the magnet surface is higher than the RH concentration in a central portion of the main phase crystal grain.

For the magnet of No. 17, twenty main phase crystal grains were randomly selected at the position which was 300 μm deep from the magnet surface, and upon checking the selected main phase crystal grains, it was confirmed that the RH concentration in an outer crust of the main phase crystal grain was higher than the RH concentration in the central portion of the main phase crystal grain in 80% or more (i.e., 16 or more) of them. Moreover, in a magnet cross section of No. 17, an extent from the magnet surface to near the magnet center (at least 200 μm) was subjected to a line analysis by the aforementioned EDX, thus confirming that both the Pr and RH concentrations gradually decreased from the magnet surface toward the magnet central portion (i.e., the concentrations became gradually lower).

INDUSTRIAL APPLICABILITY

According to the present invention, a sintered R-T-B based magnet having a high remanence and a high coercivity can be produced. A sintered magnet according to the present invention is suitable for various types of motors such as motors to be mounted in hybrid vehicles, home appliance products, and the like which are exposed to high temperatures.

REFERENCE SIGNS LIST

12 main phase composed of $R_2T_{14}B$ compound

14 grain boundary phase

**14*a*** intergranular grain boundary phase

**14*b*** grain boundary triple junction

The invention claimed is:

1. A sintered R-T-B based magnet comprising a main phase crystal grain and a grain boundary phase, the sintered R-T-B based magnet containing:

R: not less than 27.5 mass % and not more than 35.0 mass %, R is at least two rare-earth elements which always includes Nd and Pr;

B: not less than 0.80 mass % and not more than 1.05 mass %;

Ga: not less than 0.05 mass % and not more than 1.0 mass %;

M: not less than 0 mass % and not more than 2 mass %, where M is at least one of Cu, Al, Nb and Zr; and a balance T, where T is Fe, or Fe and Co, and impurities, wherein, a Pr/Nd which is a ratio of a concentration of Pr to a concentration of Nd in a central portion of a main phase crystal grain that is located at a depth of 300 μm from a magnet surface is lower than 1; and a Pr/Nd which is a ratio of a concentration of Pr to a concentration of Nd in an intergranular grain boundary that is located at a depth of 300 μm from the magnet surface is higher than 1; and a portion that includes a Ga concentration that decreases from the magnet surface to a magnet interior and that includes a dimension of at least 200 μm measured from the magnet surface to the magnet interior.

2. The sintered R-T-B based magnet of claim 1, wherein $$[T]/55.85>14[B]/10.8 \text{ is satisfied,}$$

where [T] is the T content in mass % and [B] is the B content in mass %.

3. The sintered R-T-B based magnet of claim 1, wherein the heavy rare-earth element, where the heavy rare-earth element is at least one of Dy and Tb, accounts for 1 mass % or less.

4. The sintered R-T-B based magnet of claim 3, wherein the heavy rare-earth element, where the heavy rare-earth element is at least one of Dy and Tb, accounts for not less than 0.05 mass % and not more than 0.30 mass %.

5. The sintered R-T-B based magnet of claim 4, wherein a heavy rare-earth element concentration in an outer crust of the main phase crystal grain that is located at a depth of 300 μm from the magnet surface is higher than a heavy rare-earth element concentration in the central portion of the main phase crystal grain.

6. The sintered R-T-B based magnet of claim 1, wherein the Pr/Nd in the intergranular grain boundary that is located at a depth of 300 μm from the magnet surface is higher than 1.1.

7. The sintered R-T-B based magnet of claim 1, wherein the B concentration is in a range of not less than 0.80 mass % and not more than 0.95 mass %.

* * * * *